US009155393B2

(12) United States Patent
Hurford et al.

(10) Patent No.: US 9,155,393 B2
(45) Date of Patent: Oct. 13, 2015

(54) CHAIR

(71) Applicant: Okamura Corporation, Kanagawa (JP)

(72) Inventors: Alexander Hurford, Kanagawa (JP); Yoshinori Isogai, Kanagawa (JP)

(73) Assignee: Okamura Corporation (JP)

( * ) Notice: Subject to any disclaimer, the term of this patent is extended or adjusted under 35 U.S.C. 154(b) by 0 days.

(21) Appl. No.: 14/355,931

(22) PCT Filed: Nov. 2, 2012

(86) PCT No.: PCT/JP2012/078455

§ 371 (c)(1),
(2) Date: May 2, 2014

(87) PCT Pub. No.: WO2013/065816

PCT Pub. Date: May 10, 2013

(65) Prior Publication Data

US 2014/0312668 A1 Oct. 23, 2014

(30) Foreign Application Priority Data

Nov. 4, 2011 (JP) ..... 2011-242752
Nov. 4, 2011 (JP) ..... 2011-242753
Nov. 4, 2011 (JP) ..... 2011-242756

(51) Int. Cl.
*A47C 3/025* (2006.01)
*A47C 7/46* (2006.01)
*A47C 1/032* (2006.01)

(52) U.S. Cl.
CPC ..... *A47C 7/46* (2013.01); *A47C 1/03261* (2013.01); *A47C 7/462* (2013.01)

(58) Field of Classification Search
CPC ..... A47C 7/46; A47C 7/462
USPC ..... 297/284.7, 284.4, 284.1, 284.8
See application file for complete search history.

(56) References Cited

U.S. PATENT DOCUMENTS

| | | | | | |
|---|---|---|---|---|---|
| 5,062,677 | A * | 11/1991 | Jay et al. | 297/440.2 |
| 5,829,837 | A * | 11/1998 | Reiersen | 297/352 |
| 6,471,294 | B1 * | 10/2002 | Dammermann et al. | 297/284.7 |
| 6,575,530 | B1 * | 6/2003 | Fischer et al. | 297/284.4 |
| 7,029,071 | B2 * | 4/2006 | Watson et al. | 297/411.35 |
| 7,798,572 | B2 * | 9/2010 | Scheck et al. | 297/284.4 |
| 2004/0245825 | A1 * | 12/2004 | Battey et al. | 297/284.4 |
| 2005/0206209 | A1 * | 9/2005 | Schweikarth et al. | 297/411.36 |
| 2007/0216208 | A1 * | 9/2007 | Maier et al. | 297/284.4 |
| 2014/0084660 | A1 * | 3/2014 | Norman et al. | 297/452.1 |

FOREIGN PATENT DOCUMENTS

| | | | |
|---|---|---|---|
| EP | 1226773 | | 7/2002 |
| JP | 4133067 | B | 2/2004 |
| JP | 2006-280417 | A | 10/2006 |
| JP | 4575233 | B | 11/2006 |
| JP | 2008-119217 | A | 5/2008 |
| JP | 2010-063820 | A | 3/2010 |
| JP | 2010-081974 | | 4/2010 |
| JP | 2011-103933 | A | 6/2010 |

* cited by examiner

*Primary Examiner* — Chi Q Nguyen

(74) *Attorney, Agent, or Firm* — Skinner and Associates; Joel Skinner

(57) ABSTRACT

A lumbar support on a chair comprises a lumbar support body in which a vertical width gradually becomes smaller from right and left ends to the middle; four mounting portions spaced apart from each other vertically on the lumbar support body and moving vertically along a guide on each of the pair of side frame rods and an operating member connected to each of the mounting portions on the lower edge.

8 Claims, 33 Drawing Sheets

(a)

(b)

(l)

(k)

(j)

(i)

(h)

CHAIR

TECHNICAL FIELD

The present invention relates to a chair in which a lumbar support is mounted to the backrest to move vertically.

BACKGROUND OF THE INVENTION

In a chair in which a lumbar support is mounted on the backrest, the lumbar support comprises a body; a pair of connecting portion suspending from the lower ends of the sides; and a handle extending sideward of the lower end of the side edge of the connecting portion, the handle running through the side of the back frame or backrest body to enable a vertical position of the lumbar support to be adjusted by the handle in Patent Literature 1.

A lumbar support comprises a body; and a pair of operating portions suspending from the lower ends of the sides and having a knob extending sideward at the lower end in Patent Literature 2. The right and left sides of the body are supported by the bracket in side members to move vertically.

The lumbar support holding portion stands in the middle of the lower end of the back frame in Patent Literature 3. The lumbar support body is mounted in the middle on the lumbar support holding portion and adjusted in a vertical position.

Patent Literature 4 discloses that the vertical guide member along the backrest is mounted and the lumbar support is moved along the guide member.

Patent Literature 5 discloses that the lower end of the lumbar support is under a bent point of the backrest and the lumbar support is moved vertically.

PRIOR ART

Patent Literatures

Patent Literature 1: JP2008-119217A
Patent Literature 2: JP4575233B2
Patent Literature 3: JP4133067B2
Patent Literature 4: JP2010-063820A
Patent Literature 5: JP2011-103933A

SUMMARY OF THE INVENTION

Problems to be Solved by the Invention

In the lumbar support of the chair in Patent Literature 1, the body is rectangular and has an inverted-U-shape. The connecting portion is provided at the lower ends of the body and is relatively wide. It is difficult to elastically deform the body backward effectively, and a effective support area of the body for supporting the back of the occupant is small. Hence, it is not possible to support the whole back comfortably and it is not advantageous as a lumbar support.

The right and left handles which also act as a support for the body are supported by the sides of the back frame. When the backrest is reclined, the load of the back of the occupant acts on the body of the lumbar support and a great twisting force acts on the handles. Thus, the handles are likely damaged for a long use.

The lumbar support of the chair in Patent Literature 2 has an inverted-U shape which has at the lower ends a pair of operating portions, and is supported by a pair of brackets projecting inward at the inner sides of the right and left side members. Similar to the above, it is difficult to elastically deform the body backward effectively and an effective support area of the body for supporting the back of the occupant becomes small. It is not possible to support the whole back comfortably.

The lumbar support on the chair in Patent Literature 3 is supported by the lumbar-support holding portion standing in the middle of the lower end of the back frame in the back frame. The width of the lumbar support is limited and it is not possible to support the back of the occupant as broad as possible.

A pair of handles is disposed at the upper end of the lumbar support body, and it is difficult to operate the handle when the occupant sits on the chair.

Furthermore, the lumbar support in Patent Literatures 1 and 2 is supported at two points right and left with two sides of the back frame and the lumbar support in Patent Literature 3 is supported at only one point in the middle by the lumbar support holding portion standing on the back frame. When the lumbar support is adjusted in its vertical position by the two handles, the lumbar support wobbles right and left and is unlikely to move upward and downward smoothly without uniform force acting on the handles.

As mentioned above, the lumbar support is supported at only two points and adjusted in its vertical portion with right and left sides of the back frame in Patent Literature 1. When the back support position in the back frame is bent to project forward, it becomes more difficult to provide a member for supporting both of the sides of the lumbar support at the curved portion. As described in Patent Literature 1, the member for supporting the right and left handles for the lumbar support is generally provided on a straight line above or below the curved portion.

However, when the member for supporting both of the sides of the lumbar support is provided on the straight line of the back frame, a moving path of the lumbar support becomes only one direction such as a vertical direction and becomes a straight line. Hence, it is not possible to move the lumbar support along the curved portion of the back frame, and the back surface of the back of the occupant involves uneven contact with the front surface of the lumbar support. The occupant would unlikely feel comfortable.

Recently, it is popular to provide a chair in which the backrest projects at a position corresponding to the back of the occupant. In such a chair, in Patent Literature 3, by merely moving the lumbar support vertically, close to a position where the ridge of the backrest projects forward to support the back, a longitudinal position of the lumbar support becomes relatively rear. It becomes difficult for the occupant to feel a support force by the lumbar support.

In Patent Literature 4, the lumbar support merely moves along the shape of the backrest. Hence, a support force is strong at a bent point and becomes weaker at a position apart from the bent point. The lumbar support is supported only at one point in the middle and is thus likely to wobble. The middle of the lumbar support is only likely to bend and a suitable support force is not gained.

In Patent Literature 5, it is possible to control the moving path to move the lumbar support forward and upward even beyond the bent point by adjusting the length of the support portion. However, the upper part of the lumbar support moves longitudinally of the chair at a position apart from the backrest. Hence, the whole lumbar support is likely to move backward as the lumbar support moves upward. Hence, the lumbar support cannot push the back of the occupant strongly, and it is difficult to gain a suitable support force.

In view of the disadvantages, it is a main object of the invention to provide a chair in which a lumbar support body is elastically deformed backward effectively, wherein an effective support area for the back of an occupant becomes broader so that the back of the occupant may be supported comfortably, the lumbar support body is supported by the back frame stably and operation capability of an operation portion is enhanced.

It is another object of the invention to provide a chair in which the lumbar support body can be moved stably and smoothly to support the back of the occupant comfortably with a moving path along a curved portion even if the back frame is curved to project forward at a lower part.

It is further object of the invention to provide a chair in which the moving path of the lumbar support is controlled optimally so that a great support force may suitably be gained.

According to the present invention, the foregoing problems are solved by the following items:

(1) There is provided a chair in which a lumbar support is movable vertically along a pair of side frame rods of a back frame, the lumbar support comprising:

a lumbar support body in which a lower edge gently projects upward so that a vertical width gradually becomes smaller from right and left ends to a middle;

four mounting portions spaced apart from each other vertically on the lumbar support body and moving vertically along a guide on each of the right and left side frame rods; and an operating member connected to each of the right and left mounting portions on the lower edge of the lumbar support body.

The lower edge of the lumbar support body is curved to project upward, and the vertical width of the lumbar support body gradually becomes smaller from the right and left ends to the middle. The middle portion which the back of the occupant strongly touches is likely to bend backward and the back can be supported comfortably.

The lumbar support body is stably supported at four points on the guides of the right and left side frame rods with the four mounting portions at the sides. Hence, the lumbar support body can be moved vertically and smoothly without wobbling transversely of the chair. Even if the lumbar support body is bent backward, a twisting force does not act on the mounting portions.

Furthermore, the operating member is connected to the right and left lower mounting portions. The operating member is handled by a hand downward when the occupant sits on the chair, thereby enhancing operation capability of the operating member.

(2) In the item (1), a horizontal length of the lumbar support body is approximately equal to a distance between facing surfaces of the right and left side frame rods, and the four mounting portions project from a side edge of the lumbar support body outward and are supported on the guides of the side frame rod.

The whole lumbar support body is likely deformed backward, and an effective support area for supporting the back surface of the back becomes larger, thereby supporting the whole back comfortably.

(3) In the item (1), the operating member is supported to move vertically by the guide at a lower part of the side frame rod so that a grip of the operating member projects sideward from the side frame rod.

The grip projects from the outer side of the side frame rod, thereby enhancing operation capability of the operating member when the occupant sits on the chair.

(4) In the item (2), mounting portion projects outward from a corner at which the side edge of the lumbar support body meets the lower edge.

The operating member connected to the lower mounting portion is below the middle of the lumbar support body. The operating member is handled by a hand which is lower, thereby further enhancing operation capability of the operating member.

(5) In the item (1), a vertical groove which is open forward is formed on a front surface of the side frame rod and a guide member for guiding the upper mounting portion is detachably attached in the vertical groove from front.

The guide member is attached in the groove in the side frame rod, and the upper mounting portion is supported on the side frame rod and guided vertically.

The upper mounting portions can easily be attached and detached to the side frame rods from front.

(6) In the item (1), the lower mounting portion has a backward portion which is detachably connected from front in an inner side end of the operating member.

The lower mounting portions of the lumbar support body can easily be connected to the operating member from front of the side frame rods. In particular, with the item (5), the upper and lower mounting portions can easily be supported detachably on the side frame rods from front.

(7) In item (1), a curved portion which gently projects forward is formed on a lower part of each of the right and left side frame rods, the right and left upper mounting portions are guided to move obliquely backward and upward by the guide above the curved portion of each of the right and left side frame rods, and the right and left lower mounting portions are guided to move obliquely forward and upward by the guide below the curved portion.

An upper moving path of the lumbar support body differs from that of a lower moving path. When the lumbar support body is moved upward, the lower part of the lumbar support body is moved obliquely forward and upward from below, and the upper part of the lumbar support body is moved obliquely backward and upward from below.

Hence, in order to adjust the vertical position of the lumbar support body, the position can be moved on a moving path along the curved portion of each of the right and left side frame rods. The back surface of the back of the occupant does not unevenly come in contact with the lumbar support body thereby supporting the back comfortably.

(8) In the item (7), a vertical guide hole is formed on the guide below the curved portion of each of the right and left side frame rods, and the grip of the operating member is supported by the guide hole to move vertically and projects through the guide hole from an outer side surface of the side frame rod, an inner side projecting inward from the guide of the operating member being connected to each of the right and left lower mounting portions.

The operating member is guided along the vertical guide hole on the guide of each of the right and left side frame rods and moved vertically and stably. The operating member is handled by the hand which is lower, thereby enhancing operation capability of the operating member.

Advantage of the Invention

According to the present invention, there is provided a chair in which the back of the occupant can be supported comfortably, wherein the chair has a lumbar support stably supported on side frame rods of a back frame.

DETAILED DESCRIPTION OF THE DRAWINGS

Embodiments of the present invention will be described with respect to the drawings.

Figure 1:
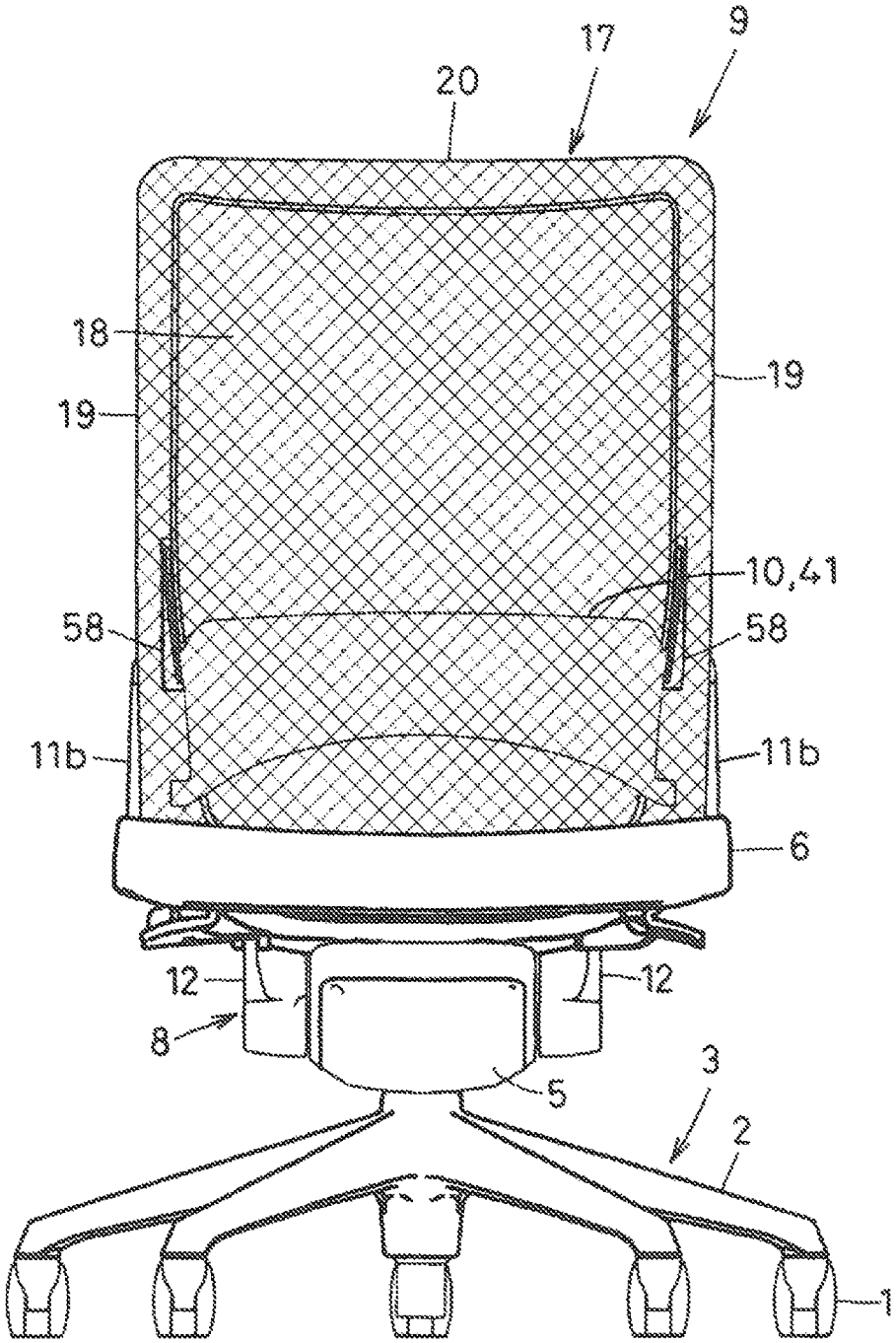
FIG. 1 is a front elevational view illustrating a first embodiment of a chair according to the present invention.
Figure 2:
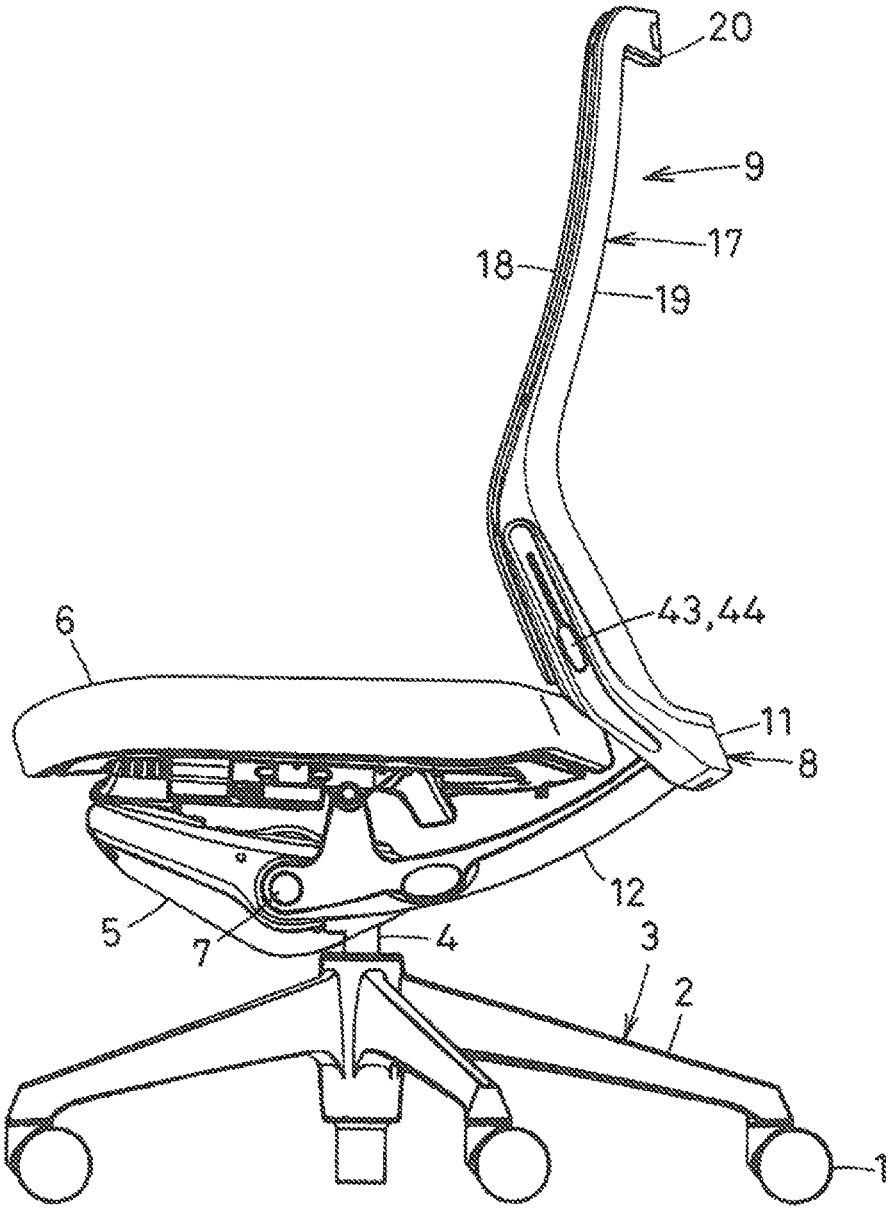
FIG. 2 is a side elevational view thereof.

FIG. 1 is a front elevational view of a chair with a first embodiment with a lumbar support according to the present invention and FIG. 2 is a side elevational view thereof.

The chair comprises a leg unit 3 comprising five radial legs 2 each of which has a caster 1; a telescopic column 4 which stands at the center of the leg unit 3 and houses a gas spring (not shown); a base 6 the rear end of which is fixed on the upper end of the column 4; a seat 4 supported on the base 5; a backrest support a front end of which is pivotally mounted to the base 5 via a shaft 7; a backrest 9 supported on the upper rear part of the backrest support 8; and a lumbar support 10 in the middle of the backrest 9.

The base 5 is rectangular and has an upper opening covered with a cover. The base 5 comprises biasing means (not shown) biasing the backrest support 8 forward anytime; and adjusting means (not shown) adjusting a biasing force of the biasing means. The biasing and adjusting means do not directly relate to the present invention, their concrete structure and detailed description are not described.

The backrest support 8 comprises a backrest support frame 11 comprising a lateral frame 11*a* and a pair of upright frames 11*b*, 11*b* at side edges of the lateral frame; and a pair of backrest support rods 12, 12 each of which has a rear end coupled to the lateral frame 11*a* of the backrest support frame 11. They are made of Al or Al alloy. The backrest support is not shown in FIGS. 3, 4 and 7.

The lateral frame 11*a* is gently arcuate to project backward in the middle and is inclined at each side obliquely upward. The right and left upright frames 11*b* are inclined forward and upward such that they are directed in the same direction as a lower part of a side frame rod 19 of a back frame 17 later described.

The right and left backrest support rods 12 are inclined forward and downward and gently curved downward.

The front ends of the right and left backrest support rods 12 are pivotally mounted on each side of the base 5 via the shaft to turn vertically.

The rear ends of the right and left backrest support rods 12 are fixed to the lateral frame 11*a* of the backrest support frame 11 as below.

The rear ends of the right and left backrest support rods 12 are firmly engaged in a pair of engagement holes 13, 13 (in FIGS. 4 and 7) at right and left sides of the lateral frame 11*a*.

Screws 15, 15 are inserted from above through two holes 14, 14 on the upper surface corresponding to right and left engagement holes 13 of the lateral frame 11*a*, and the lower ends of the screws 15, 15 are engaged and tightened in two female thread holes 16, 16 at the rear ends of the backrest support rods 12 thereby constructing the backrest support 8 in which the right and left backrest support rods 12 are firmly fixed to the rear ends of the right and left backrest support rods 12.

The backrest 9 comprises a rectangular back frame 13 made of rigid synthetic resin and a stretched member 18 stretched over the front surface of the back frame 17. The stretched member 17 is excluded in FIGS. 3-6.

In FIGS. 3-6, the back frame 17 comprises a pair of side frame rods 19, 19 gently curved at a lower part; an upper frame rod 20 coupling the side frame rods 19, 19 to each other and curved in the middle; a lower frame rod 21 coupling the lower ends of the side frame rods 19, 19 to each other like a straight line; and stretching members 22, 23 for the stretched member 18 attached to the front surface and side end portions of the lower frame rod 21 with bolts 28 and nuts 30. Parts of the right and left side frame rods 19 under the curved portion C are inclined along the upright frame 11*b* of the backrest support frame 11.

Figure 3:
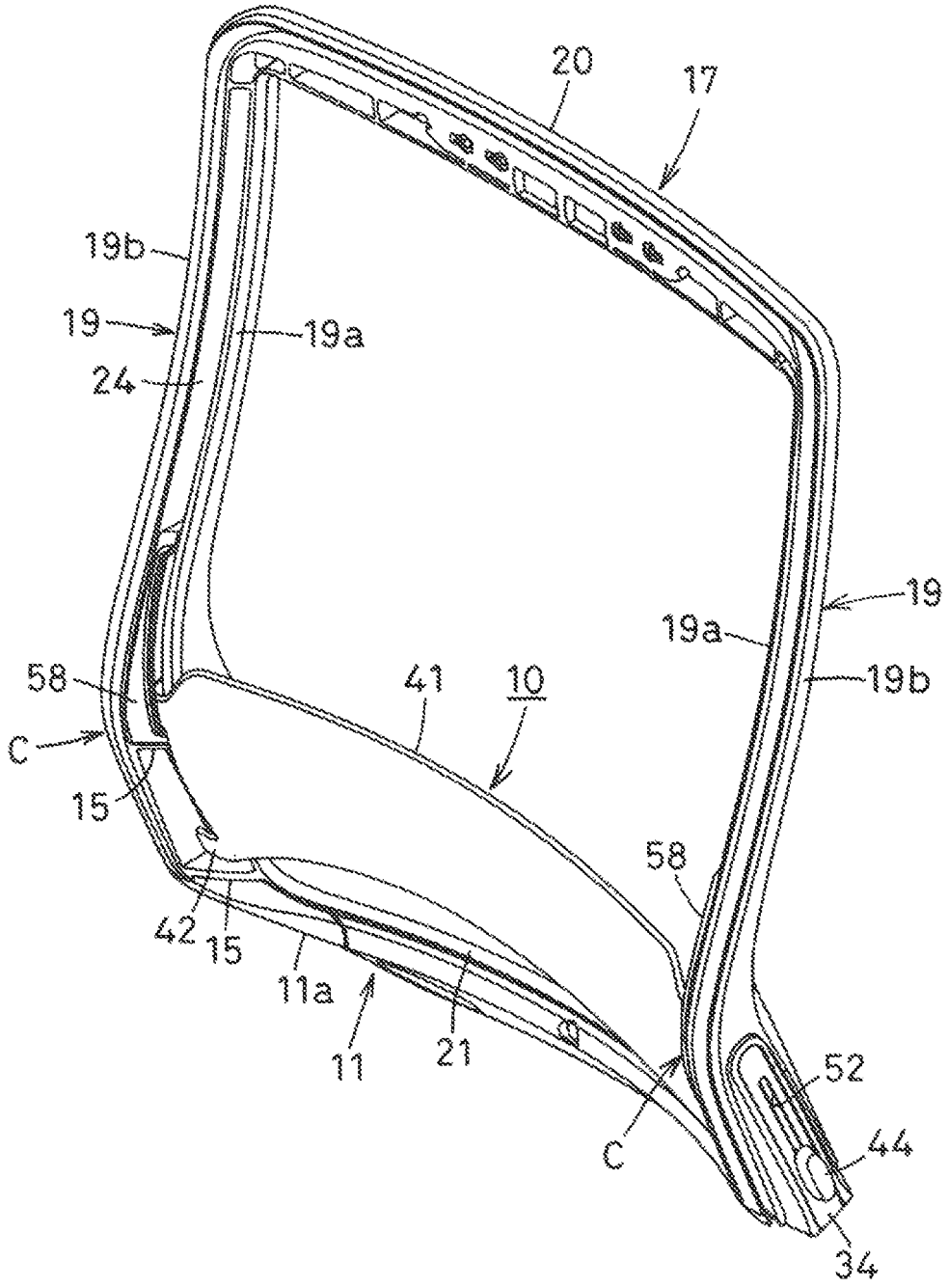
FIG. 3 is a perspective view of a back frame and a lumbar support attached thereto.
Figure 4:
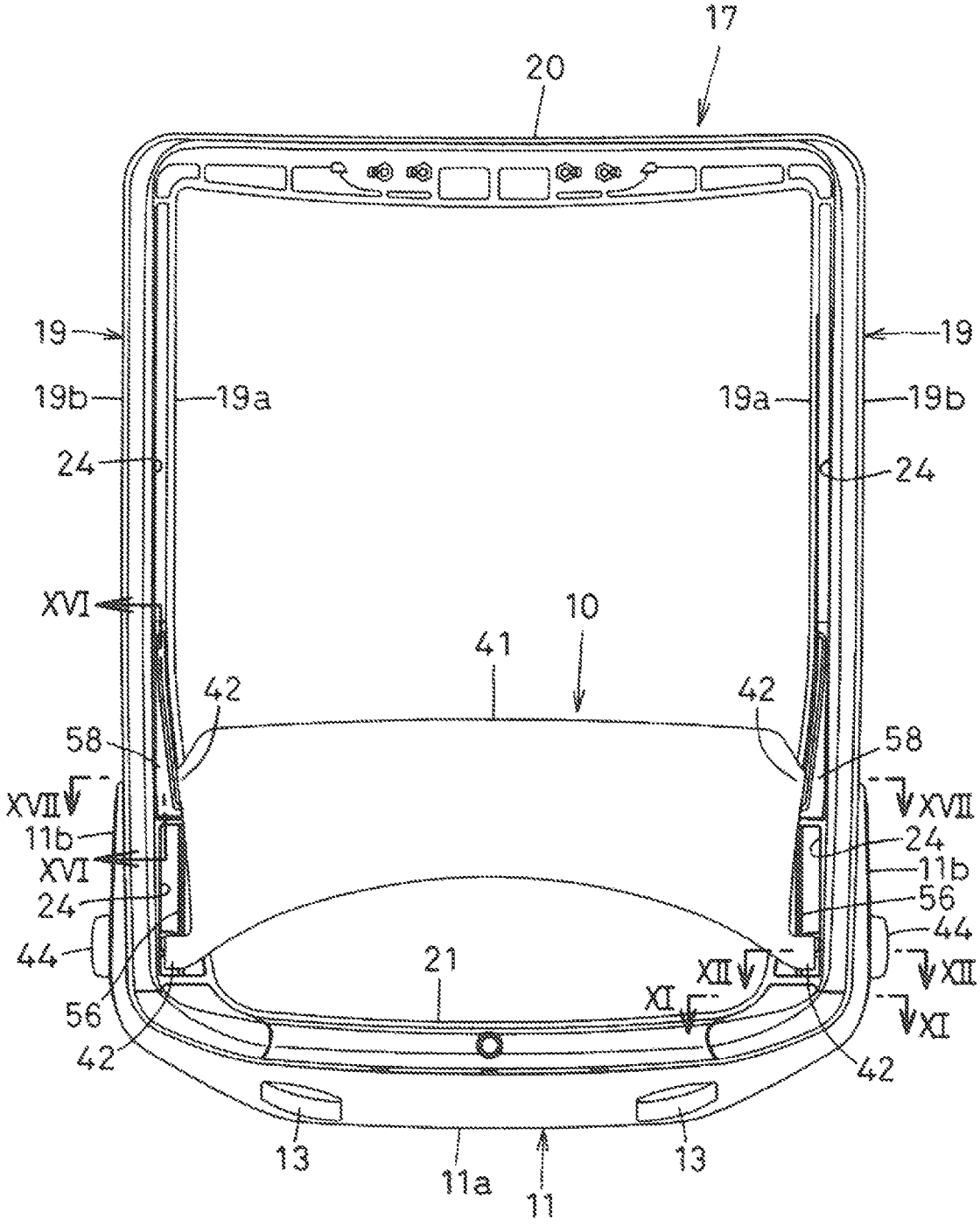
FIG. 4 is a front elevational view thereof.
Figure 5:
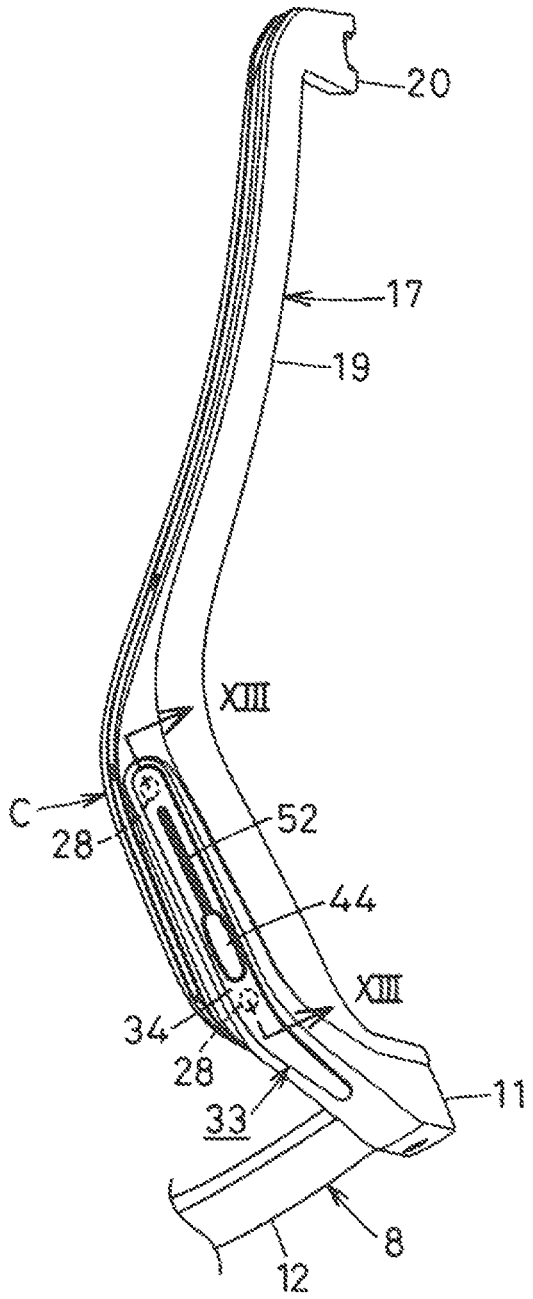
FIG. 5 is a side elevational view thereof.

In FIGS. 3 and 4, on the front surfaces of the right and left side frame rods 19, 19 and the lower frame rod 21, there is formed a groove 24 having a front opening longitudinally of the back frame 17. The groove 24 on the side frame rod 18 becomes wider gradually downward of the middle in FIG. 4. The groove 24 is partitioned with horizontal ribs 25, 25 close to the curved portion C of the side frame rod 19.

Figure 17:
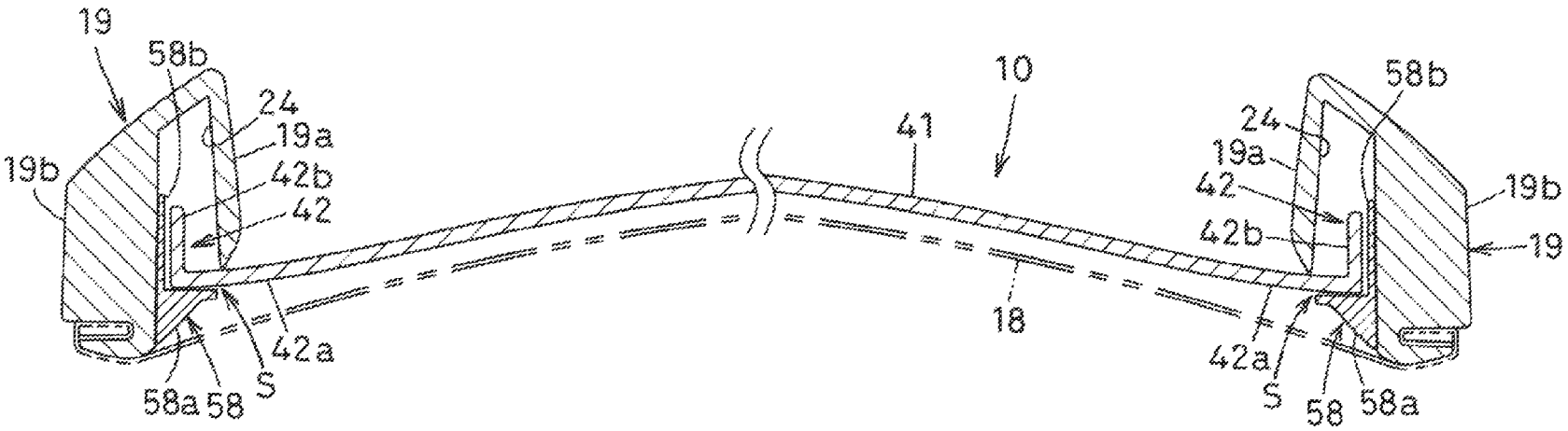
FIG. 17 is an enlarged horizontal sectional end view taken along the line XVII-XVII in FIG. 4.

In FIG. 17, the groove 24 of the side frame rod 19 is formed between an inner side portion 19*a* and an outer side portion 19*b*, and the outer side portion 19*b* is thicker than the inner side portion 19*a* so that the outer side portion 19*b* projects forward of the inner side portion 19*a*.

Figure 6:
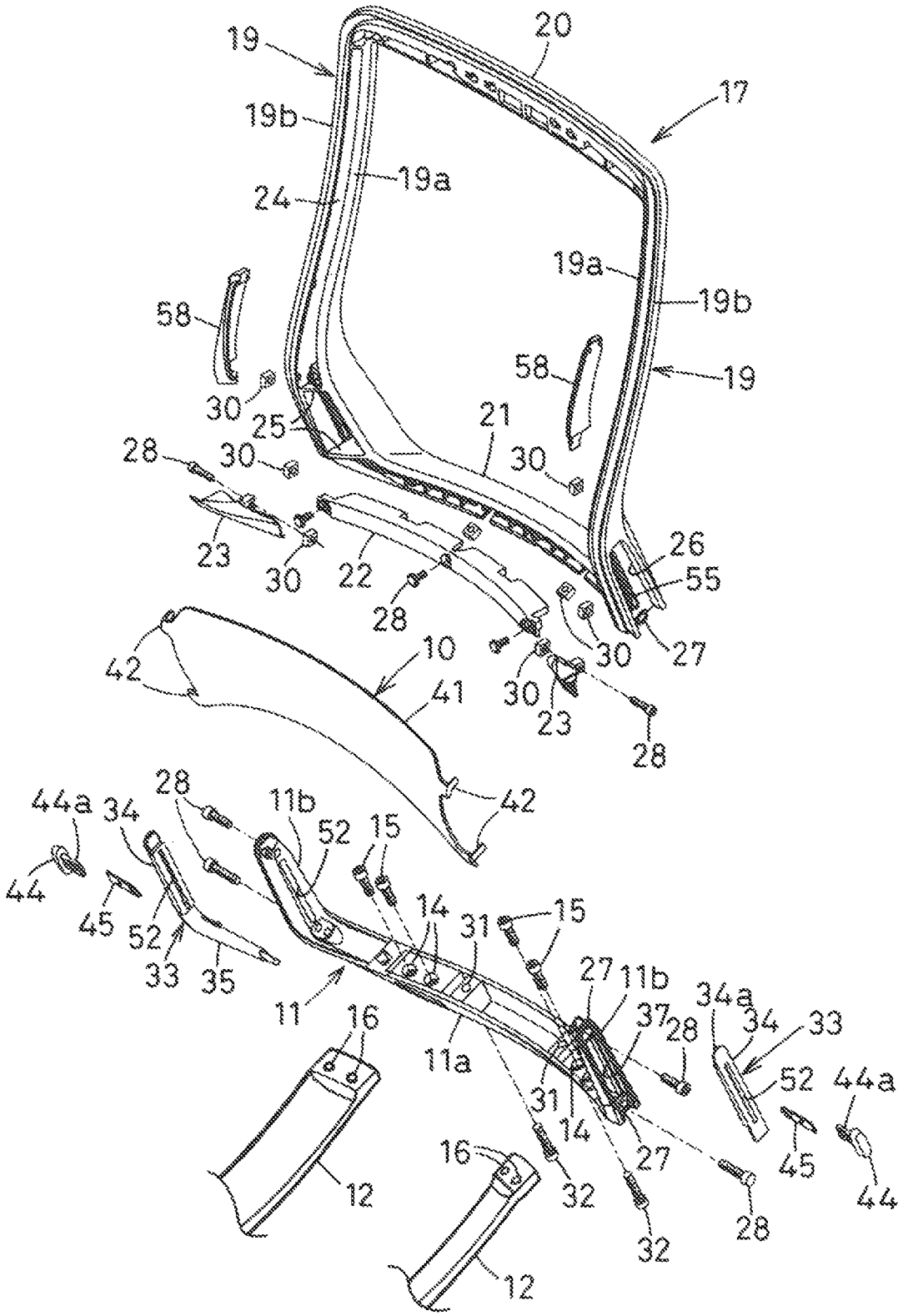
FIG. 6 is an exploded perspective view of the back frame, a lumbar support body attached thereto and a backrest support.

In FIG. 6, in an outer side of each of the right and left side frame rods 19, 19 under the curved portion c, there is formed an engagement recess 26 which is open downward and sideward. The upright frame 11*b* of the backrest support frame 11 engages in the recess 26.

In order to mount the backrest support frame 11 over the back frame 17, the engagement groove 26 of each of the right and left side frame rods 19, 19 is engaged with each of the right and left upright frames 11*b*, 11*b* of the lateral frame 11*a* from above. The lower surface of the lower frame rod 21 of the back frame 17 comes in contact with the upper surface of the lateral frame 11*a*, and the back frame 17 is provisionally supported by the backrest support frame 11.

Figure 13:
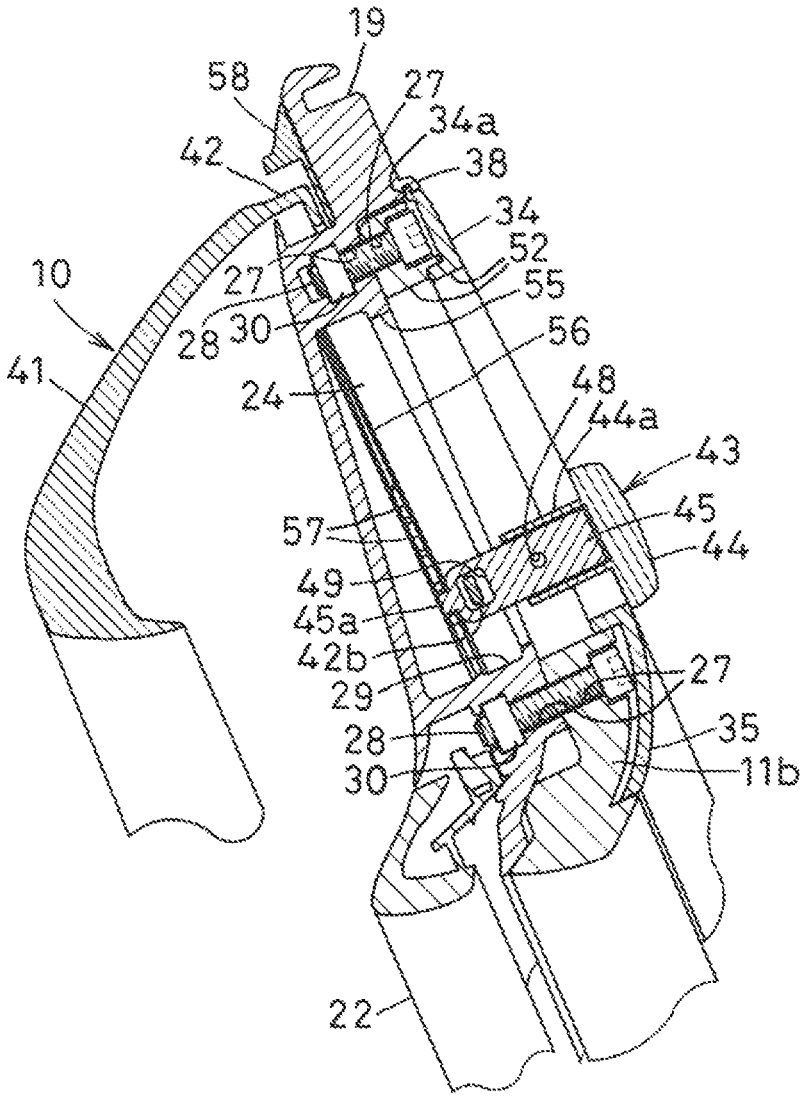
FIG. 13 is an enlarged vertical sectional front view taken along the line XII-XII in FIG. 5.

In FIG. 13, bolts 28, 28 are inserted into a pair of holes 27, 27 of the engagement recess 26 of each of the right and left side frames rods 19 of each of the right and left upright frame 11*b*. The bolts 28, 28 are engaged with retaining rectangular nuts 30, 30 fitted in nut-holding portions 29, 29, in the recess 29 of the right and left side frame rods 19, and tightened, so that lower parts of the side frame rods 19 are fixed to the right and left upright frames 11*b*.

Bolts 32, 32 are inserted through a pair of holes 31, 31 in the middle of the lateral frame 11*a*, engaged in rectangular nuts 30, 30 which are not turned with the ribs in the recess 25 of the lower frame rod 21 and tightened, so that the lower frame rod 21 is fixed to the lateral frame 11*a*. Thus, while the lower part of the back frame 17 is engaged with the backrest support frame 11, the back frame 17 is firmly fixed to the backrest support frame 11.

After the back frame 17 is fixed to the backrest support frame 11, cover members 33, 33 are mounted on the outer sides of the right and left upright frames 11*b*, 11*b*.

Figure 7:
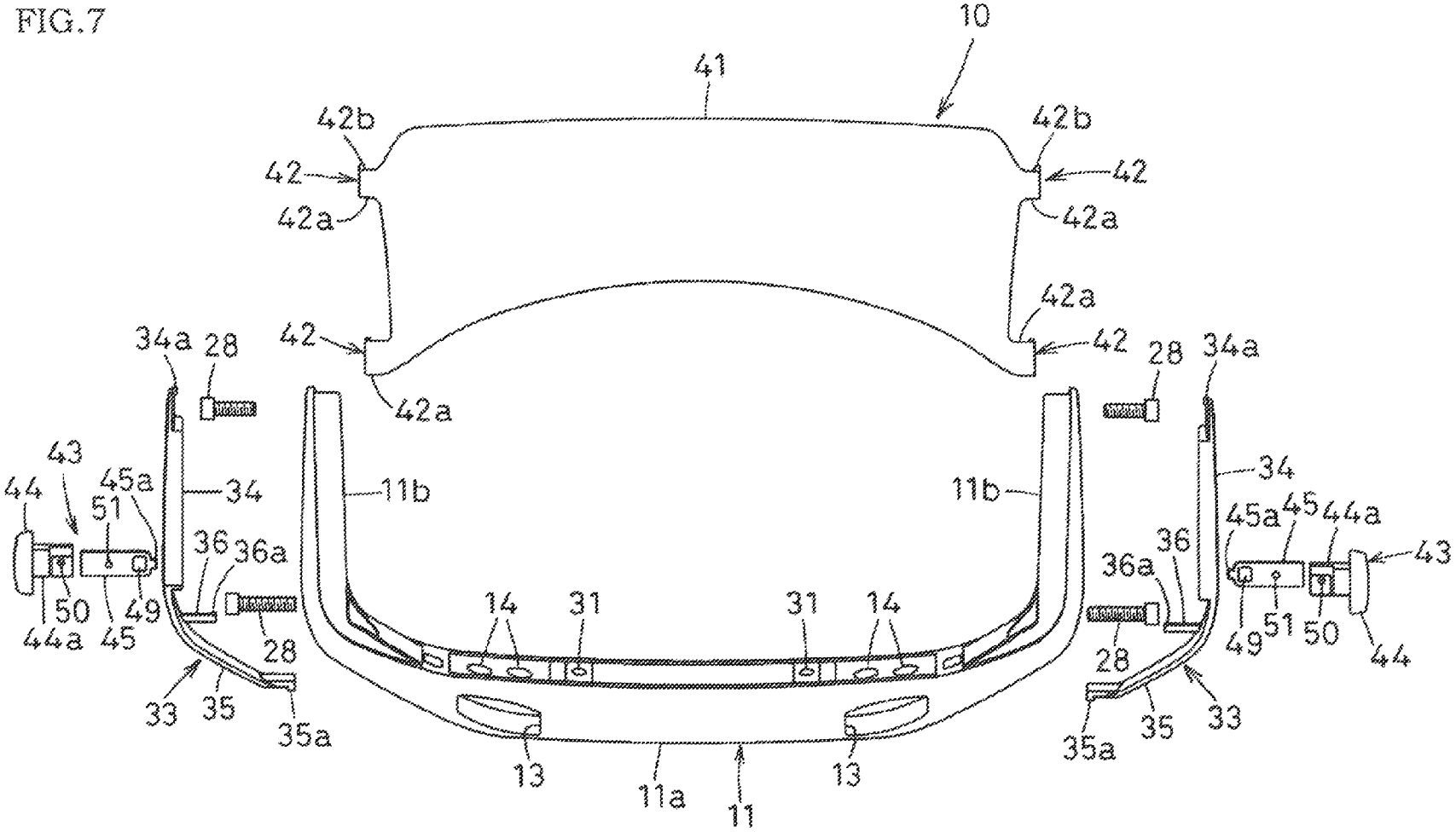
FIG. 7 is an exploded front elevational view of the lumbar support body, a backrest support frame and a cover member and an operation member attached thereon.
Figure 8:
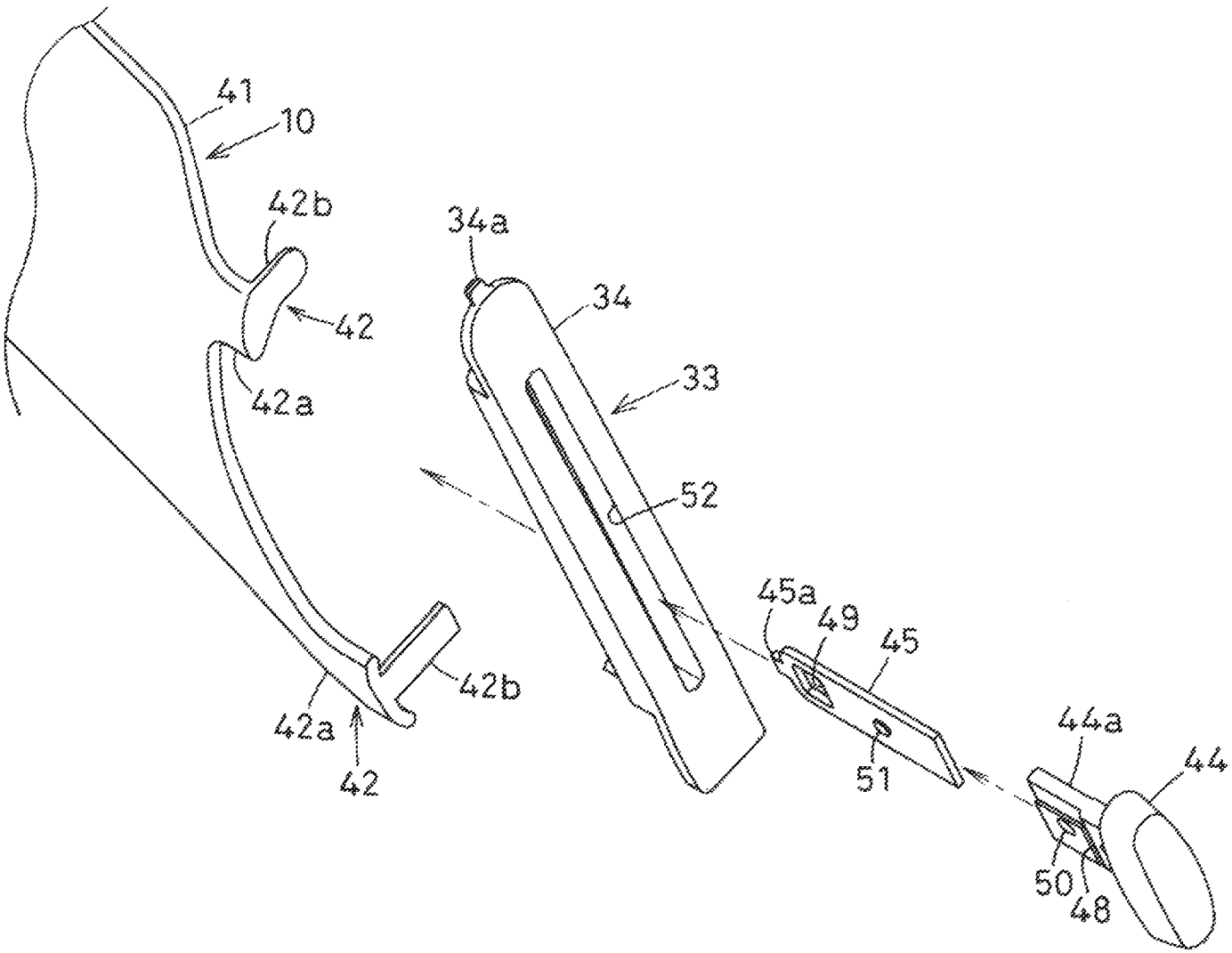
FIG. 8 is an enlarged exploded perspective view of the side edge of the lumbar support body, the cover member and the operation member.

In FIGS. 6-8, the cover member 33 comprises a long-plate-like upward portion 34 wider except the upper end and an inward portion 35 inclined inward and downward along the tilted surface of the backrest support frame 11. An engagement portion 36 projects inward from a coupling portion of the upward portion 34 to the inward portion 35. The upward portion 34 and the upright frame 11*b* over which the upward projection 34 is attached also act as a guide for guiding an operating member 43 and right and left mounting portions 42 at the lower part of a lumbar support body 41 (later described) via the operating member 43 while supporting them to move vertically.

An inward and upward engagement claw 34*a* is formed at the upper end of the upward portion 34, a downward engagement claw 35*a* is formed at the inner edge of the inward portion 35, and a backward engagement claw 36*a* is formed on an engagement portion 36.

On the outer side of each of the right and left upright frames 11*b* and the lateral frame 11*a* of the backrest support frame 11, there is formed a vertical recess 37 which fits with the cover member 33 and has an upper part which goes through.

Figure 11:
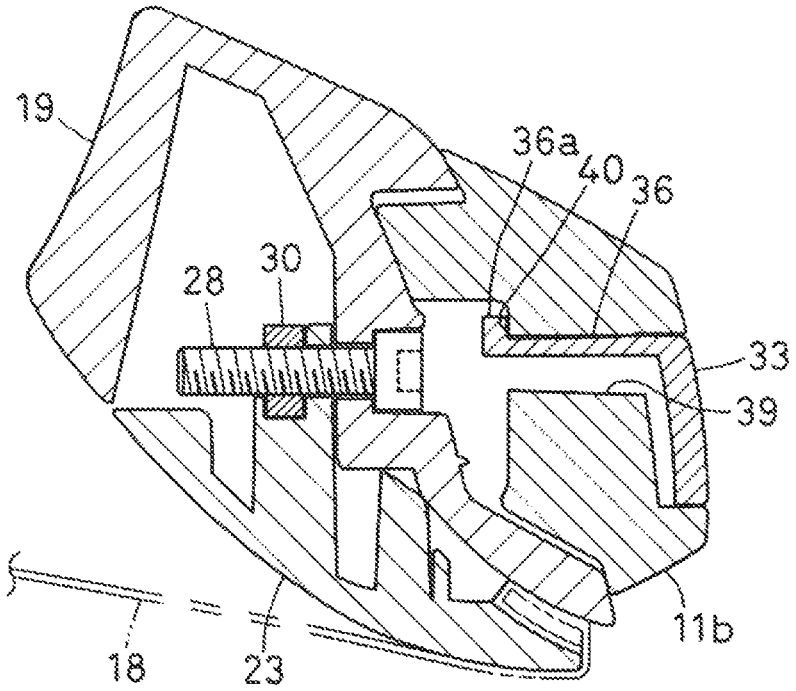
FIG. 11 is an enlarged horizontal sectional end view taken along the line XI-XI in FIG. 4.

To mount the cover member 37, the cover member 33 is engaged in the recess 37 of the backrest support frame 11. In FIG. 13, the upper engagement claw 34*a* at the upper end of the upward portion 34 engages in an inner surface of a downward portion 38 at the upper edge of the engagement recess 26 of the side frame rod 19*b*. In FIG. 11, the engagement portion 36 engages in an opening 39 of the upright frame 11, and the engagement claw 36*a* at the end of engagement portion 36 elastically engages with an engagement step 40 in the opening 39. The downward engagement claw 35*a* of the inward portion 35 engages with an engagement step (not shown) at the lower end of the recess 37.

Hence, the cover member 33 is mounted over the recess 37 on the outer side of the backrest support frame 11 to cover the heads of the upper and lower bolts 28, and if required, the cover member 33 can be removed.

In FIGS. 3, 4, 7 and 8, the lumbar support 10 comprises an elastically-deformable synthetic resin lumbar support body 41; four mounting portions 42 on the diagonal line of the lumbar support body 41; and a pair of operating members 43 to be connected to the right and left lower mounting portions 42, and is attached close to the curved portions C of the right and left side frame rods 19 to move vertically. The mounting portion 42 comprises a short outward portion 42 extending sideward; and a backward portion 42*b* at the end thereof. The pair of upper mounting portions 42 projects slightly below the upper edge of the lumbar support body 41.

The lumbar support body 41 is gently curved to project backward in the middle and the lower edge of the lumbar support body 41 is gently curved upward in the middle. The vertical width gradually becomes smaller toward the middle from the right and left ends, and the vertical section is curved such that the middle gently projects forward. The lumbar support body 41 is like a rectangle which is approximately as wide as a distance between the side frame rods 19*b* and 19*b* of the back frame 19.

The operating members 43, 43 for moving the lumbar support body 41 vertically are attached as below to the upward portion 34 which also acts as a lower guide at the cover member 33 mounted to the lower part of the side frame rod 19. The cover members 33 and operating members 43 are symmetrical right and left and provide similar attachment to each other. The following description relates only to the right side.

Figure 9:
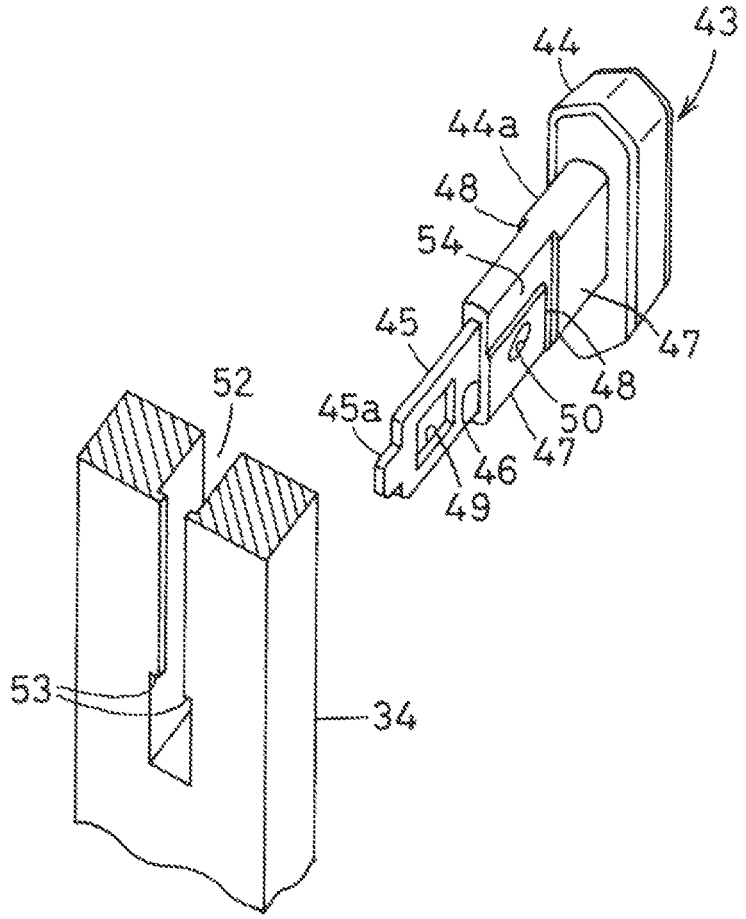
FIG. 9 is an enlarged perspective view before the operation member is attached to an upward portion of the cover member.
Figure 10:
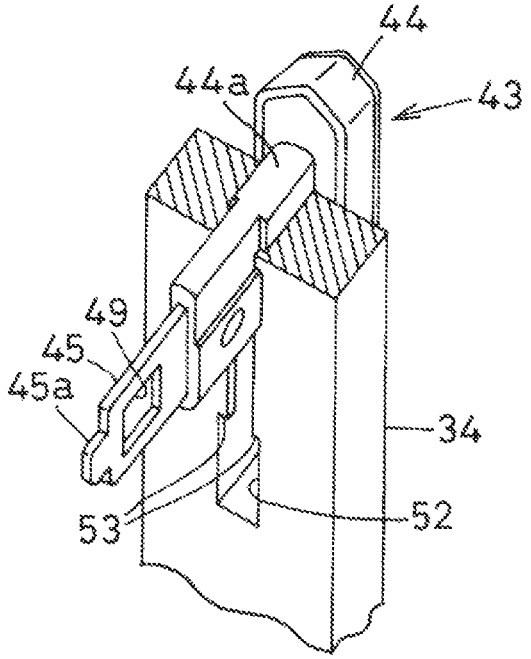
FIG. 10 is an enlarged perspective view after attachment.

In FIGS. 7 to 9, the operating member 43 comprises a synthetic-resin handle 44; and a connecting member 45 with the metal-plate lumbar support body 41. A thin inward projection 44 is molded with the handle 44 on the inner side surface of the handle 44. In the inward projection 44*a*, there is formed a vertical slit 46 which is open inward. The outer side of the connecting member 45 engages in the slit 46.

The inward projection 44*a* has a front lower thicker portion 47 and a sideward portion 47. On the front rear surfaces between the front lower thicker portion 47 and the sideward portion 47, there are formed vertical grooves 48, 48 in FIG. 12.

The connecting member 45 is longer than the inward projection 44*a* and comprises a slightly-elastically-deformable vertical plate. At the inner end, the connecting member 45 has a narrower engagement portion 45*a* which can come in contact with an engagement recess 57 on the lower front surface of the side frame rod 19. At the inner end of the connecting member 45 closer to the engagement portion 45*a*, there is formed a rectangular connecting through hole 45 through which the backward portion 42*b* of the lower mounting portion 42 of the lumbar support body 41 slides. The connecting hole 49 is wider than the backward portion 42*b* so that the backward portion 42*b* moves only transversely of the chair. Even if the lumbar support body 41 is bent backward, its motion is not transmitted to the operating member 43 via the backward portion 42*b*.

When the connecting member 45 fits in the engagement hole 46, a projection 51 on the front surface of the connecting member 45 engages in an engagement hole 50 communicating with the engagement hole 46, thereby preventing the connecting member 45 from disengaging from the engagement hole 46 of the inward projection 44*a*.

In FIGS. 6, 8, 9 and 12, in the upward portion 34 of the cover member 33 and upright frame 11*b*, there are formed vertical guide holes 52, 52 through which the inward projection 44*a* of the handle 44 can move vertically and put into the side frame rod 19 of the back frame 17 transversely of the chair. Inward projections 53, 53 face each other on an opening edge except a lower portion of the guide hole 52 of the upward portion 34. The upward portion 34 is attached over a lower part of the side frame rod 19 inclined forward and upward, and the guide hole 52 is also inclined forward and upward.

The guide hole 52 formed in the upward portion 34 and upright frame 11*b* constitute part of the guide for guiding the operating member 43 and lower mounting portion 42 of the lumbar support body 41 connected to the operating member 43. Without the upward portion 34 and upright frame 11*b*, the guide hole 52 may be formed in the thicker outer side portion 19*b* of the side frame rod 19.

The width between the inward projections 53 and 53 is approximately equal to thickness of a thinner portion 54 other than the thicker portions 47, 47 of the inward projection 44*a*. The grooves 48 on both the front and back surfaces of the inward projection 44*a* is in sliding contact with the inward projections 53, 53.

In FIGS. 9, 10, 12 and 13, in order to attach the operating member 34 into the upward portion 34, the inward projection 44*a* of the handle 44 is engaged into the lower end of the guide hole 52 in the upward portion 34 and upright frame 1*b* of the backrest support frame 11 until the inner side surface of the handle 44 comes in contact with or becomes closer to the outer side surface of the upward portion 34. In the engagement, the end of the connecting member 45 including the connecting hole 49 passes through an elongate hole 55 of the engagement recess 26 in the side frame rod 19, and is placed in the groove 24 of the side frame rod 19 in FIG. 13.

Then, the operating member 43 is moved upward, and the grooves 48, 48 on both of the front and back surfaces of the inward projection 44*a* are engaged with the inward projections 53, 53. Thus, the operating member 43 is not disengaged from the guide hole 52 and kept from moving transversely of the chair, thereby moving vertically with the inward projection 53 through the guide hole 52. In order that the operating member 43 may not come off the guide hole 52, when the lumbar support body 41 is placed at a lower limit, the operating member 43 connected to the lumbar support body 41 does not move in the guide hole 52 under the lower end of the inward projection 53. The lower limit of the lumbar support 1 is determined by a guide member 58 (later described) attached to the side frame rod 19.

Figure 12:
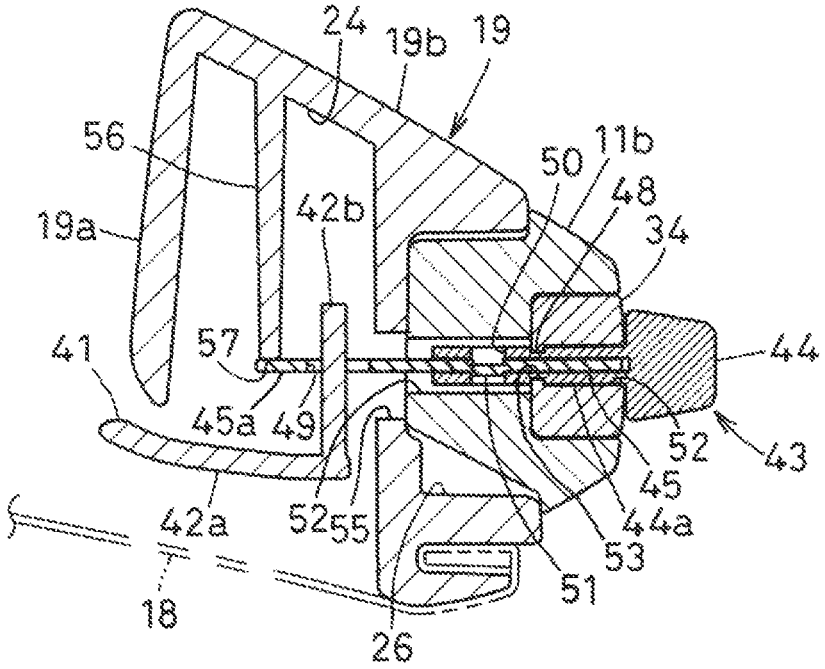
FIG. 12 is an enlarged horizontal sectional end view taken along the line XII-XII in FIG. 5.
Figure 14:
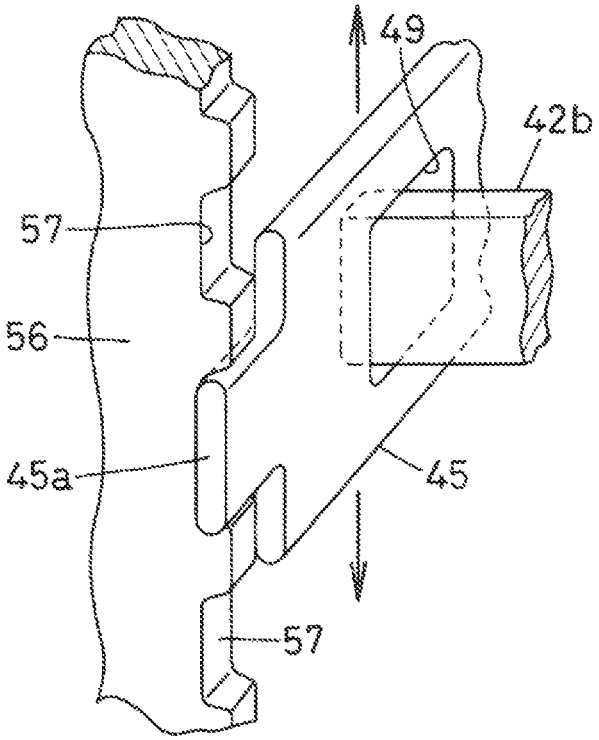
FIG. 14 is an enlarged perspective view of an engagement portion of an engagement recess with a connecting member.

In FIGS. 12 to 14, the backward portion 42*b* of the lower mounting portion 42 of the lumbar support body 41 is detachably inserted from front into the connecting hole 49 of the connecting member 45 of the operating member 43, so that the lumbar support body 41 is connected to the right and left operating members 43 (right and left are symmetrical and only right side is shown). Thus, when the right and left operating members 43 are operated vertically, the lumbar support body 41 is moved vertically therewith. Even if the lumbar support body 42 is bent longitudinally of the chair, the load does not directly act on the operating member 43.

In FIGS. 4, 13 and 14, in the groove 24 in the side frame rod 19, across the upward portion 34 attached to the side frame rod 19, there is provided a vertical projection 56 approximately perpendicular to the connecting member 45 of the operating member 43. On the front of the projection 56, there is vertically formed a plurality of engagement recesses 57 which are open forward and sideward, at regular intervals. The engagement portion 45*a* at the end of the connecting member 45 is selectively engaged in any one of the plurality of engagement recesses 57 thereby adjusting a vertical position of the lumbar support 10 stepwise in moderation.

The connecting member 45 comprises an approximately vertical plate, and is likely deformed along its thickness or longitudinally of the chair. Even if an engagement force is increased with the engagement portion 45*a* and engagement recess 57 which are both relatively long, the engagement portion 45*a* can selectively be engaged in the engagement recess 57 by a weak force. In order that the lumbar support 10 may not loosen vertically, the engagement portion 45*a* may preferably be as long as the engagement recess 57.

In the groove 24 approximately higher than the curved portion C of the right and left side frame rods 19, 19 are attached guide members 58, 58 for supporting the pair of upper mounting portions 42, 42 which moves vertically, as below.

Figure 15:
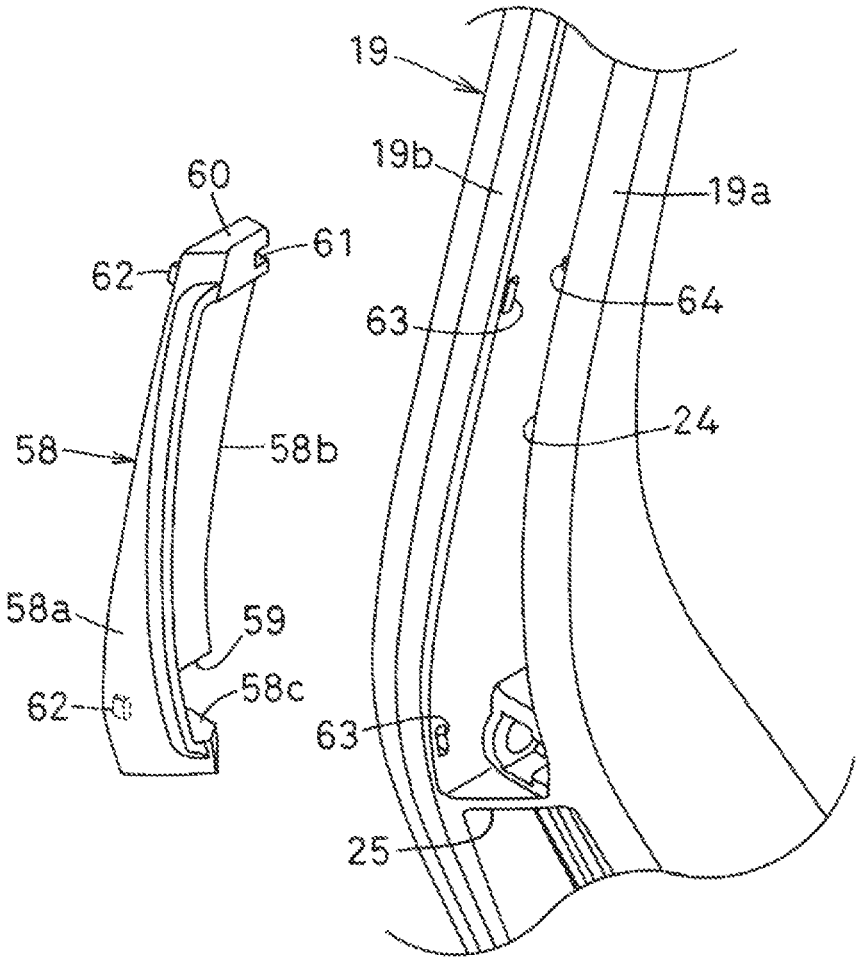
FIG. 15 is an enlarged perspective view of a side frame rod and a guide member attached thereto.
Figure 16:
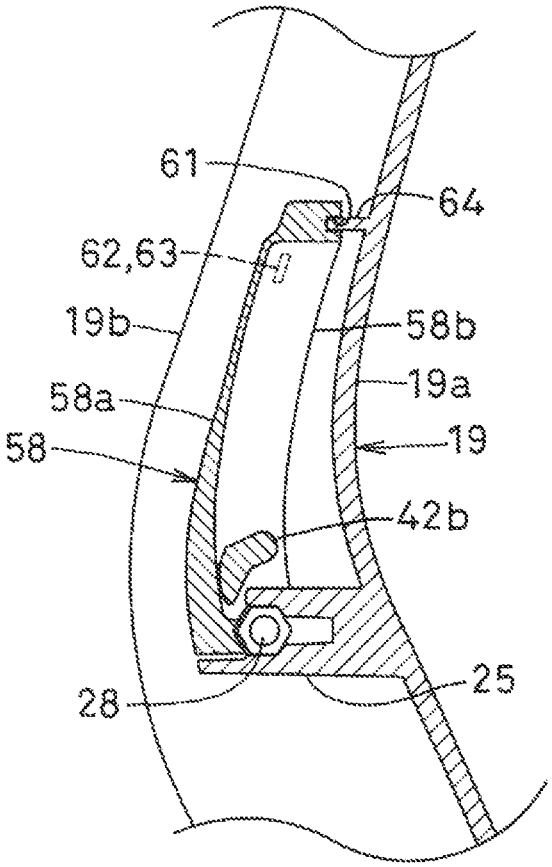
FIG. 16 is an enlarged vertical sectional side view taken along the line XVI-XVI in FIG. 4.

In FIGS. 15 to 17, there are right and left guide members 58 which are symmetrical with each other. In FIGS. 15 and 16, the left guide member 58 is only illustrated like an "L" and comprises an inward portion 58*a* which gradually becomes narrower upward; a backward portion 58*b* projecting from outer side edge; and a bottom portion 58*c* at the lower ends of the inward portion 58*a* and backward portion 58*b*. The backward portion 58*b* is curved so as to be in surface contact with a curved inner surface of the outer side portion 19*b* of the side frame rod 19. A notch 59 is formed so that the back frame 17 does not engage with the bolt 28 for fixing the back frame 17 to the backrest support frame 11.

On the back surface of a thicker portion 60 at the upper ends of the inward portion 58*a* and backward portion 58*b*, there is formed a U-shaped engagement groove 61 which is open inward and backward. A pair of engagement projections 62, 62 projects outward from the outer side surface of the backward portion 58*b*.

In order to attach the guide member 58 to the side frame rod 19, the guide member 58 is fitted from front into the groove 24 of the side frame rod 19 such that the lower surface of the bottom portion 58*c* comes in contact with the upper surface of the rib 25 in the groove 24. The upper engagement groove 61 is engaged with the projection 64 on the outer side surface of the inner side portion 19*a* of the side frame rod 19 for vertical positioning. The engagement projections 62, 62 are engaged in the recesses 63, 63 on the inner surface of the outer side portion 19*a* of the side frame rod 19. Hence, the guide member 58 is attached in the grove 24 so that it may not be taken off forward, and if required, it can be removed forward. If the front surface of the guide member 58 is in contact with the back surface of the stretched member 18 stretched over the back frame 17, the guide member 58 can be prevented from loosening back and forth securely.

The attachment position of the guide member 58 is determined such that the lumbar support 10 stops at a lower limit by contacting the backward portion 42*b* of the upper mounting portion 42 of the lumbar support body 41 with the upper surface of the bottom portion 58*c* and the operating member 43 stops at the lower limit without leaving the guide hole 52 of the upward portion 34 of the cover member 33.

In FIG. 17, between the back surface of the inward portion 58*a* of the guide member 58 and the front end of the inner side portion 19*a* of the side frame rod 19, there is formed a gap "S" slightly smaller than the thickness of the outward portion 42*a* of the upper mounting portion 42 of the lumbar support body 41. The upper mounting portions 42, 42 of the lumbar support body 41 are positioned behind the guide members 58, 58 in the groove 24. The right and left upper sides of the lumbar support body 41 are guided by the guide members 58 and the inner side portion 19*a* and moved vertically.

As the procedure for connecting the lumbar support 10, the right and left operating members 43 are mounted to the lower parts of the right and left side frame rods 19 as above before the stretched member 18 is stretched over the back frame 17.

The backward portion 42*b* of the lower mounting portion 42 of the lumbar support body 41 is put in the connecting hole 49 of the connecting member 43 from front in FIGS. 12 to 14 and the backward portion 42*b* is put in the groove 24 of the side frame rod 19 in FIG. 17. The back surface of the side edge of the lumbar support body 41 faces the front surface of the side frame rod 19 with a space. If the lumbar support body 41 is bent backward, the back surface of the side end comes in contact with the front surface of the side frame rod 19. Even if the lumbar support body 41 is bent longitudinally of the chair, the backward portion 42*b* only slides in the connecting hole 49 longitudinally of the chair. Hence, bending load by the lumbar support body 41 is unlikely to act on the whole operating member 43 including the connecting member 45.

As mentioned above, when the lumbar support body 41 is moved upward with the operating member 43 to a position where the operating member 43 does not leave the guide hole 52 of the upward portion 34 of the cover member 33, the right and left guide members 58 are attached in the grooves 24 of the side frame rods 19 in FIG. 17.

The lumbar support body 41 is moved downward to a lower limit position where the backward portion 42*b* of the upper mounting portion 42 comes in contact with the upper surface of the bottom portion 58*c* of the guide member 58. The attachment of the lumbar support 10 is completed. The lumbar support 10 is supported at four points on the right and left side frame rods 19 with four mounting portions 42 at the upper and lower ends of the lumbar support body 41. After the lumbar support 10 is connected, the operating member 43 does not leave the guide hole 52 of the upward portion 34. The outward portion 42 of the upper mounting portion 42 is in contact with or close to the back surface of the inward portion 58*a* of the guide member 58, so that the upper mounting portion 42 does not disengage from the guide member 58 forward.

Even after the stretched material 18 is stretched over the back frame 17, the lumbar support body 41 and guide member 58 can be attached from behind the back frame 17 by bending the stretched material 18 forward.

When the handle 44 of the operating member 43 is slid vertically, the lower mounting portion 42 connected to the connecting member 45 and the lumbar support body 41 are moved vertically together thereby adjusting a vertical position of the lumbar support 10. The projection 45*a* of the connecting member 45 selectively engages in the any one of the engagement recess 57 of the projection 56 in the lower groove 24 of the side frame rod 19, thereby adjusting the vertical position of the lumbar support 10 stepwise in moderation.

As mentioned above, in the first embodiment of the chair, the width of the lumbar support body 41 is approximately equal to a distance between the right and left side frame rods 19 and 19, and the four mounting portions 42 of the lumbar support body 41 is supported by the right and left side frame rods 19. Hence, the whole lumbar support body 41 can elastically be deformed backward and the whole back of the occupant can comfortably be supported because an effective support for supporting the back surface of the back becomes broader.

The four mounting portions 42 project outward of the lumbar support body 41. Even if the lumbar support body 41 is bent backward, twisting load is unlikely to act on the mounting portions 42 and the operating member 43. The lumbar support body 41 is stably supported at four points with the right and left side frame rods 19 of the back frame 17 via the four mounting portions 42 positioned on the diagonal lines, thereby moving the lumbar support body 41 up and down smoothly without loosening along its width.

The lumbar support body 41 is curved such that the middle at the lower edge projects upward, and its height gradually reduces toward the middle from the right and left ends. The middle of the lumbar support body 41 which the back strongly contacts is likely to be bent backward, and the back of the occupant can comfortably be supported.

The right and left lower mounting portions 42 are provided at corner between the curved lower edge and side edges of the lumbar support body 41 and are positioned below the lower middle edge of the lumbar support body 41. The right and left operating members 43 connected to the mounting portions 42 are below the lumbar support body 41 to which a hand of an occupant is easily accessible thereby enhancing operation capability of the operating member 43.

The right and left lower mounting portions 42 of the lumbar support body 41 and operating member 43 connected thereto are supported to move obliquely forward and upward with an obliquely forward and upward part of the side frame rod 19 under the curved portion C, and the right and left upper mounting portions 42 are supported to move obliquely backward and upward by the guide members 58 mounted to an obliquely backward and upward part of the right and left side frame members 19 slightly over the curved portion C thereby making lower and upper moving paths of the lumbar support body 41. When the lumbar support body 41 is moved upward from a lower limit position, the lower part of the lumbar support body 41 takes a moving path obliquely forward and upward from below, and the upper part takes a moving path obliquely backward and upward from below.

Hence, when a vertical position of the lumbar support body 41 is adjusted, the lumbar support body 41 can be moved along the curved portions C of the right and left side frame rods 19. The back can comfortably be supported without uneven contact of the back surface of the back of the occupant on the lumbar support body 41.

The upper and lower support positions of the lumbar support body 41 on the side frame rod 19 are positioned over and under the curved portion C. The upper, lower, right and left mounting portions 42 of the lumbar support 41 move along approximately straight lines on different tracks. Hence, a vertical position of the lumbar support 10 can be adjusted smoothly without being obstructed by the curved portion C of the side frame rod 19.

In order to mount the lumbar support body 41, after the operating members 43 are formerly mounted to the right and left side frame rods 19, the backward portions 42*a* of the right and left lower mounting portions 42 are fitted from front in the connecting holes 49 in the connecting members 45 of the operating members 43. The backward portions 42*b* of the right and left upper mounting portions 42 are fitted into the grooves 24 of the side frame rods 19. The guide member 58 is attached over the groove 24 so that the upper mounting portions 42 are prevented from taking off. While the lumbar support body 41 is held normally, the lumbar support body 41 can easily be mounted to the back frame 17 and the operating member 43 can easily be connected to the mounting portions 42 of the lumbar support body 41, and the lumbar support body 41 can easily be attached and detached.

The operating member 43 is separate from the lower mounting portion 42 of the lumbar support body 41, and the backward portion 42*a* of the lower mounting portion 42 of the lumbar support body 41 fits in the connecting hole 49 in the connecting member 45 of the operating member 43 to move longitudinally and transversely of the chair. The engagement recess 57 for adjusting a vertical position of the lumbar support body 41 stepwise is formed on the front surface of the projection 56 projecting in the groove 24 of the side frame rod 19 or an inward part spaced from the upward portion 34 and the upright frame 11*b*. Thus, even if the lumbar support body 41 is elastically deformed longitudinally of the chair, its motion will not be transmitted to the operating member 43 and engagement recess 57 via the backward portion 42*b* directly.

Bending load is not liable to act on the whole operating member 43 including the connecting member 45 from the lumbar support body 41. The lumbar support body 41 can be held at a fixed position securely and can vertically be moved stably with moderation without decreasing engagement between the engagement portion 45*a* with the engagement recess 57 or without producing uneven wear in the contact portion due to bending of the connecting member 45 along its thickness.

In the foregoing embodiment, in order to retain the operating member 43, the groove 48 in the inward portion 44*a* of the operating member 43 is engaged with the inward projection 53 on the guide hole 52 of the upward portion 34. The backward portion 42*b* of the mounting portion 42 is fitted in the connecting hole 49 of the operating member 43 to move only longitudinally of the chair, so that the operating member 43 can be retained by the backward portion 42*b* of the lumbar support body 41.

In the foregoing embodiment, the backward portion 42*b* on the mounting portion 42 of the lumbar support body 41 is engaged in the connecting hole 49 in the operating member 43 thereby connecting the operating member 43 to the mounting portion 42 of the lumbar support body 41. On the contrary, for example, the connecting member of the operating member 43 comprises an inward rod (not limited to a circular cross-section), and a recess which is open backward is formed on the backward portion 42*b* on the mounting portion 42 of the lumbar support body 41. The inward rod engages into the recess. Similar to the above, after the operating member 43 is attached on the side frame rod 19, and the backward portion 42*b* of the lumbar support body 41 is easily engaged with the rod. In this case, a washer for retaining the rod in the side frame rod 19 may be attached on the end of the rod.

Furthermore, in the foregoing embodiment, the operating member 43 and lower mounting portions 42 of the lumbar support body 41 connected therewith are supported to move vertically and guided with the upward portion 34 of the cover member 33 and the upright frame 11*b* of the backrest support frame 11. Without the cover member 33 or backrest support frame 11, the thicker outward side portion 19*b* of the side frame rod 19 may be a guide having a guide hole.

A second embodiment of a chair in which the backrest comprises a cushion will be described with respect to FIGS. 18 to 30. In each view, the right and left are determined in the chair viewed from front.

Figure 18:
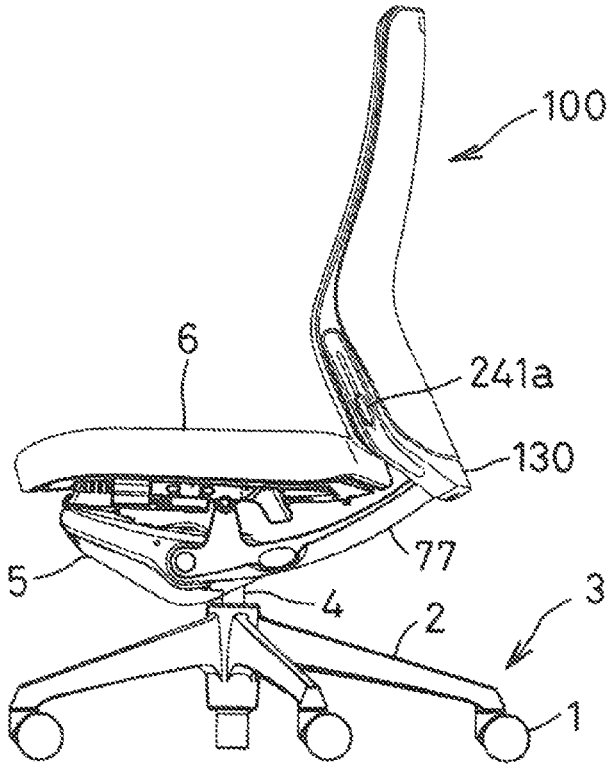
FIG. 18 is a right side elevational view of a second embodiment of a chair.
Figure 19:
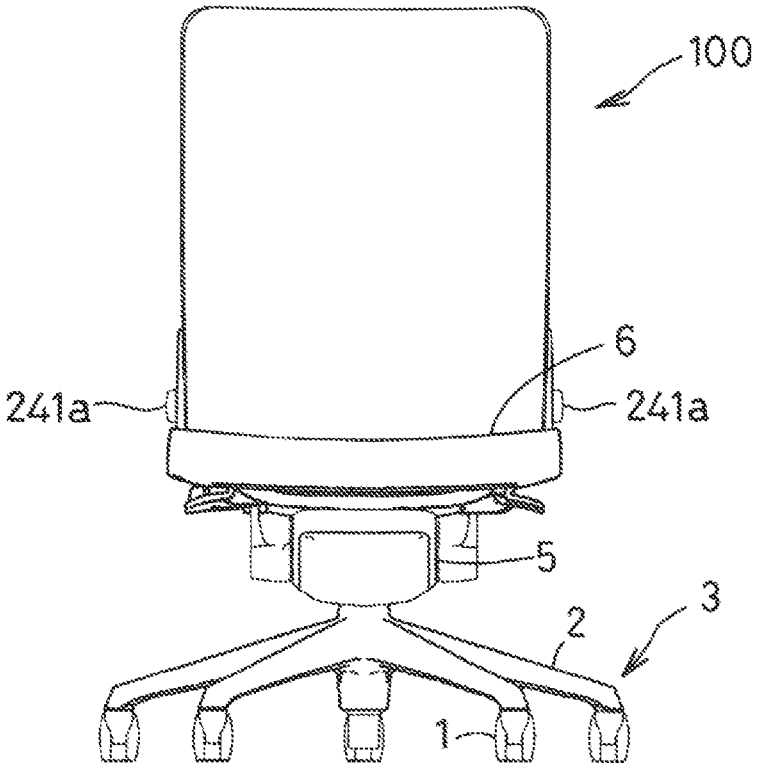
FIG. 19 is a front elevational view thereof.

FIG. 18 is a right side view of the second embodiment of the chair and FIG. 19 is a front elevational view thereof.

The chair comprises a leg unit 3 comprising five legs 2 each of which has a caster 1 at its end; a column 4 standing in the middle of the leg unit 3; a base 5 fixed to the upper end of the column 4; a seat 6 over the base 5; a pair of backrest support frames 77 pivotally mounted to the base 5 via a shaft (not shown); and a backrest 100 supported by the backrest support frame 77.

Figure 20:
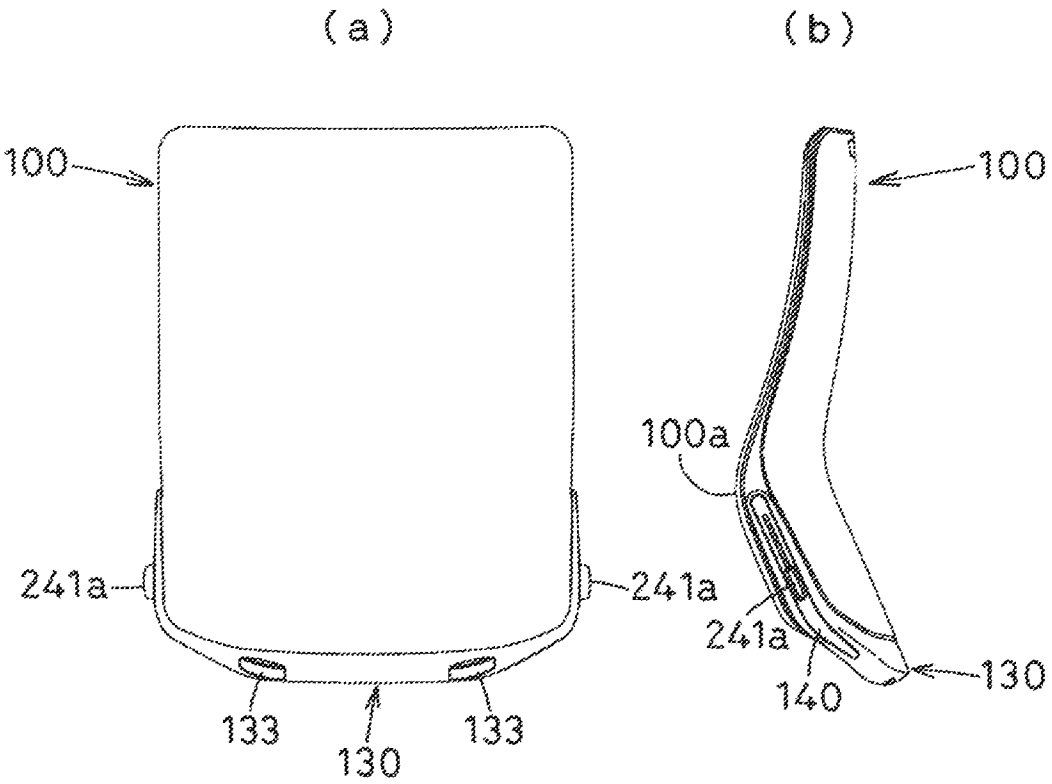
FIGS. 20 (*a*) and (*b*) are a front elevational view and a right side elevational view thereof respectively.
Figure 21:
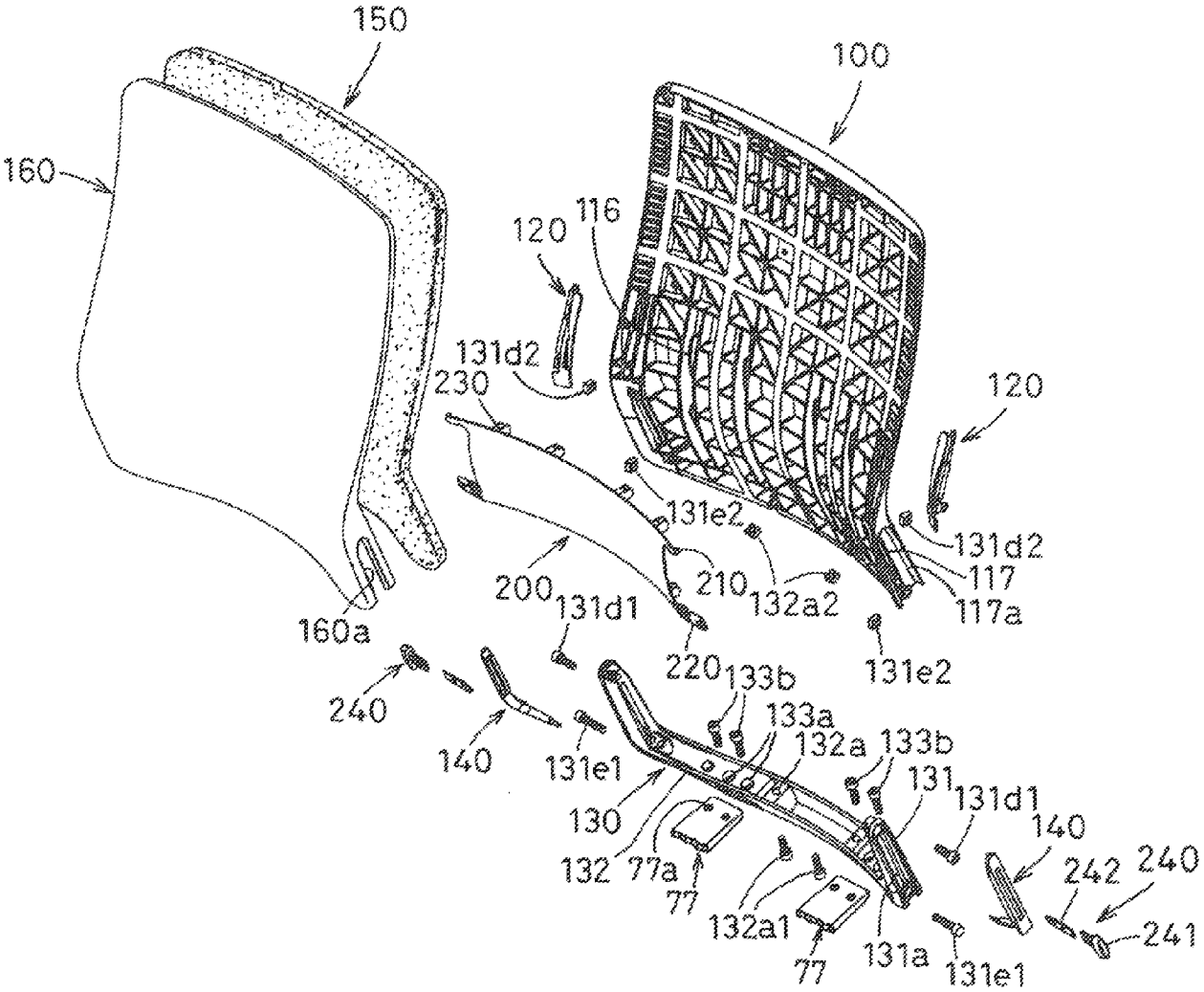
FIG. 21 is an exploded perspective view of a backrest and a lumbar support.

FIGS. 20 (*a*) and (*b*) are a front elevational view and a right side view of the backrest 100 respectively, and FIG. 21 is an exploded perspective view of the backrest 100 and the lumbar support 200.

In FIG. 21, the backrest 100 comprises an inner shell 110; a guide member 120; a backrest support 130; a cover member 140; a cushion member 150; and an upper cover 160 which are connected as below.

In this specification, even if part of the backrest 100 such as the inner shell is meant, the backrest 100 which is a broader term of the inner shell may be used.

The lumbar support 200 is mounted in the backrest 100, but in this specification, the lumbar support 200 is not included in a concept for the backrest 100 and described as what is separate from the backrest.

Figure 22:
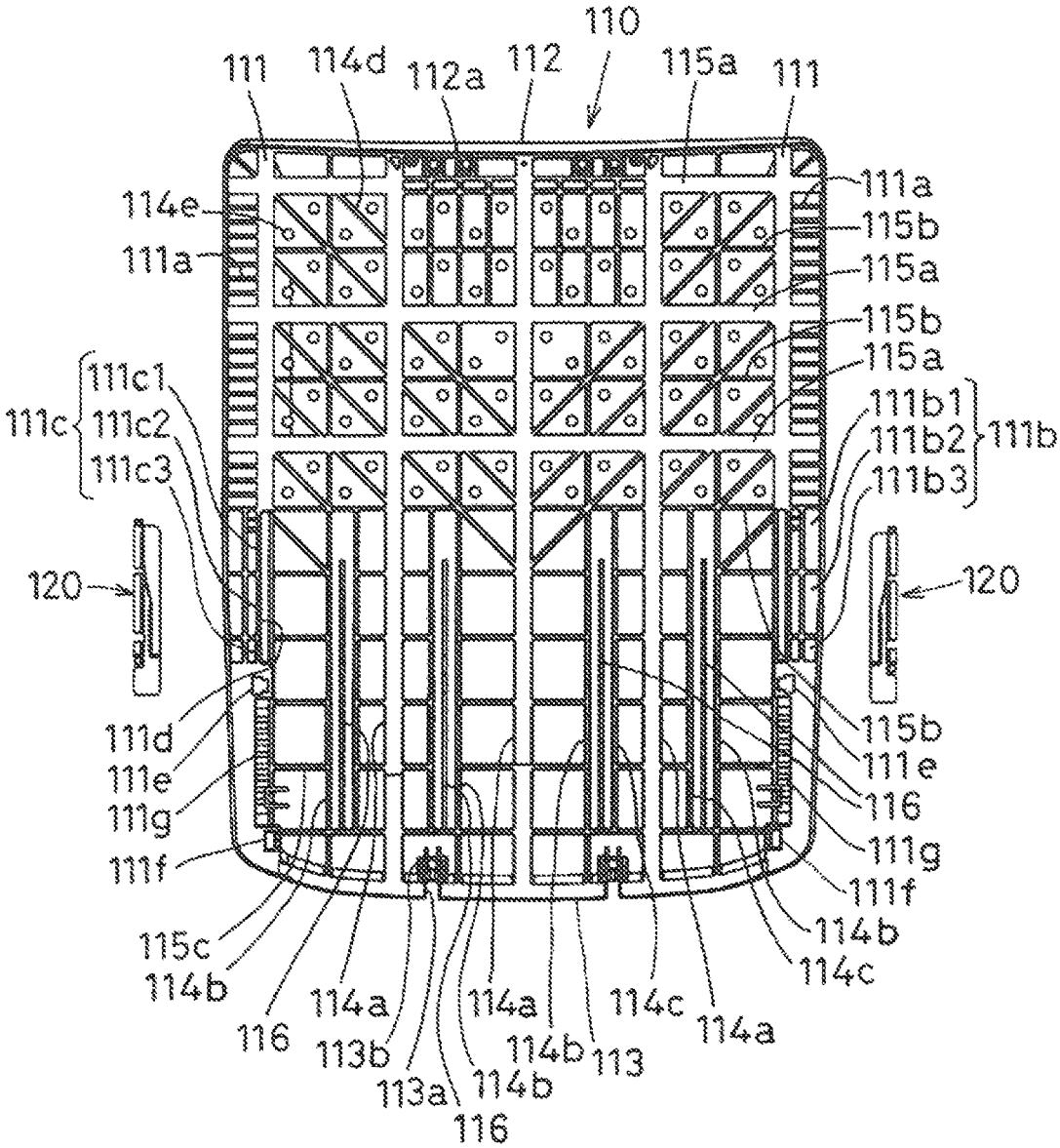
FIG. 22 is a front elevational view of an inner shell and a guide member.
Figure 23:
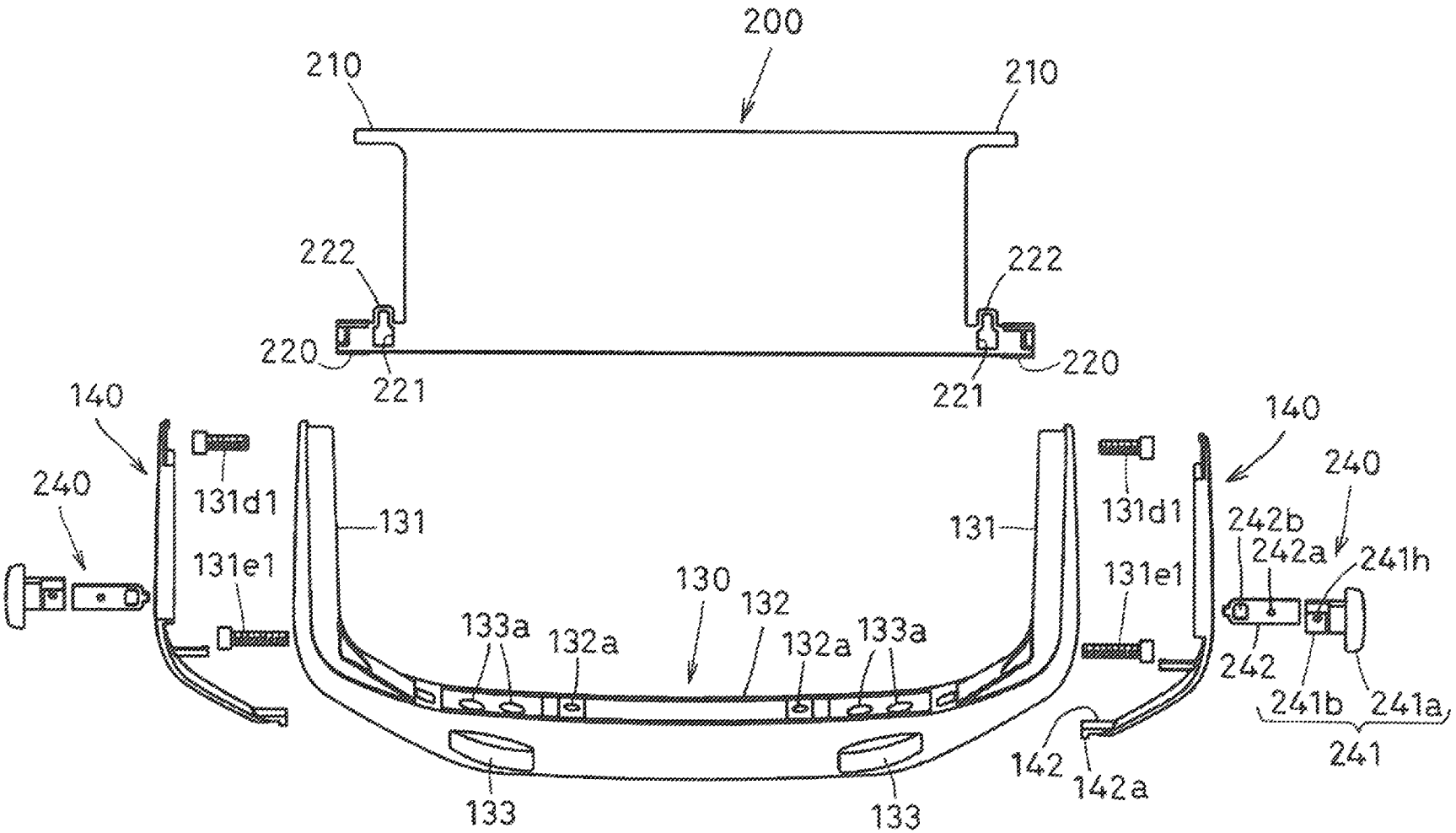
FIG. 23 is a front elevational view of the lumbar support, a backrest support, a cover member and a handle.

FIG. 22 is a front elevational view of the inner shell 110 and guide member 120, and FIG. 23 is a front elevational view of the lumbar support 200, the backrest support 130, the cover member 140 and a handle 240.

In FIGS. 21 and 22, the inner shell 110 is rectangular as viewed from front, doglegged as viewed from side and concave backward as viewed from above.

The inner shell 110 comprises on its front surface a slightly-wider side edge 111 at right and left side edges; an upper edge 112 at the upper end; and a lower edge 113 at the lower end. Between the right and left side edges 111, three vertical larger ribs 114*a* are provided at regular intervals, and three lateral larger ribs 115 are provided at regular intervals on an upper half of the inner shell 110. Between the side edge 111 and the vertical larger rib 114 and between the adjacent vertical large ribs 114*a* and 114*a*, there is a first vertical small rib 114*b*.

Between the lateral larger ribs 115*a* and 115*a* and under the lowest lateral large rib 115*a*, there is provided a first lateral smaller rib 115*b*. In the lower half of the inner shell, between the vertical large rib 114*a* and the first vertical small rib 114*b* except the middle vertical large rib 114*a*, there is provided a second vertical small rib 114*c*.

Between the first vertical small rib 114*b* and the second vertical small rib 114*c*, there is provided a vertical guide projecting line 116. On the front surface of the inner shell 110, there are provided a tilted small rib 114*d*, a through hole 114*e* and a second lateral small rib 15*c*.

Between the upper edge 112 of the inner shell 110 and the highest lateral large rib 115, four bolt-through holes 112*a* for mounting a headrest as an optional member project, but the present invention does not directly relate to the attachment of the optional member. Its description is not mentioned.

On the lower edge 113, there are formed a pair of bolt-through notches 113*a* and a pair of nut holders 113*b*, which will be described later.

On the right and left upper side edges 111, there is a plurality of recesses 111*a* which acts as reinforcement and slipping-off-prevention of the cushion member 150 over the front surface of the inner shell 110. On the upper part of a lower half of the side edge 111, grooves 111*b*, 111*c*, 111*d* are arranged in three rows. The grooves 111*b*, 111*c* in the two outer lines are divided into three vertically. The grooves 111*b*1, 111*b*2, 111*c*1, 111*c*2 in the upper and middle stages have approximately equal length, and the lower grooves 111*b*3, 111*c*3 are shorter. Under the grooves 111*c*, 111*d* in the two inner lines, nut holders 111*e*, 111*f* are spaced from each other. Between the nut holders 111*e* and 111*f*, there is provided a sliding-contact surface 111*g* later described.

A guide member 120 is mounted over the grooves 111*c*, 111*d* in the two inner lines on the side edge 111.

Figure 24:
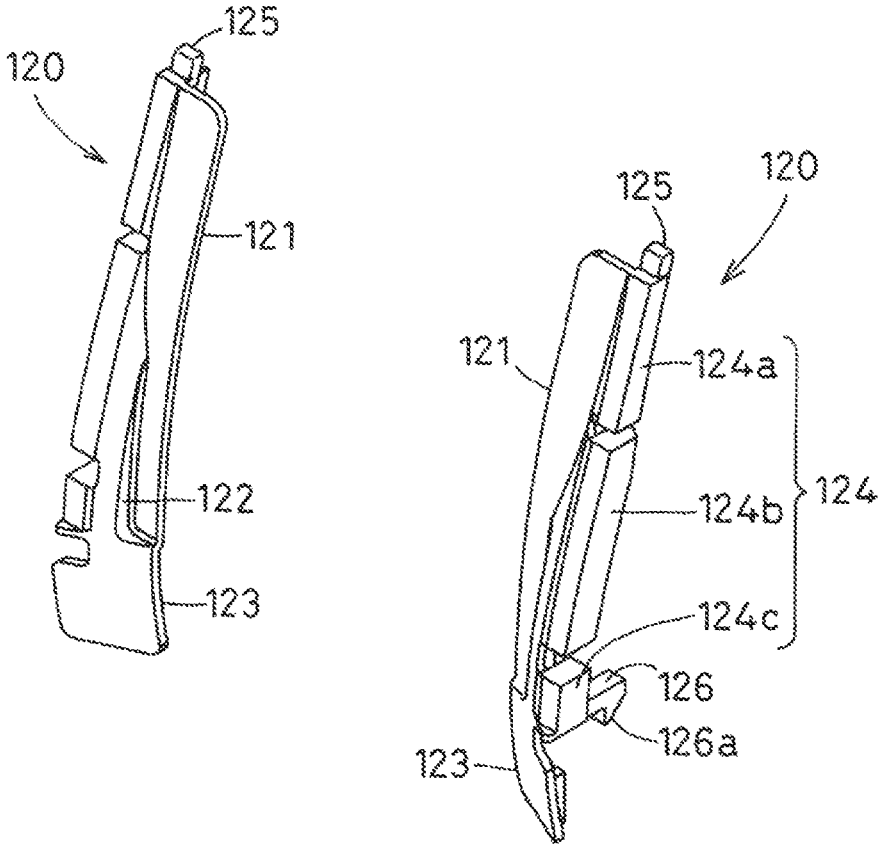
FIG. 24 is an enlarged perspective view of the right and left guide members.
Figure 25:
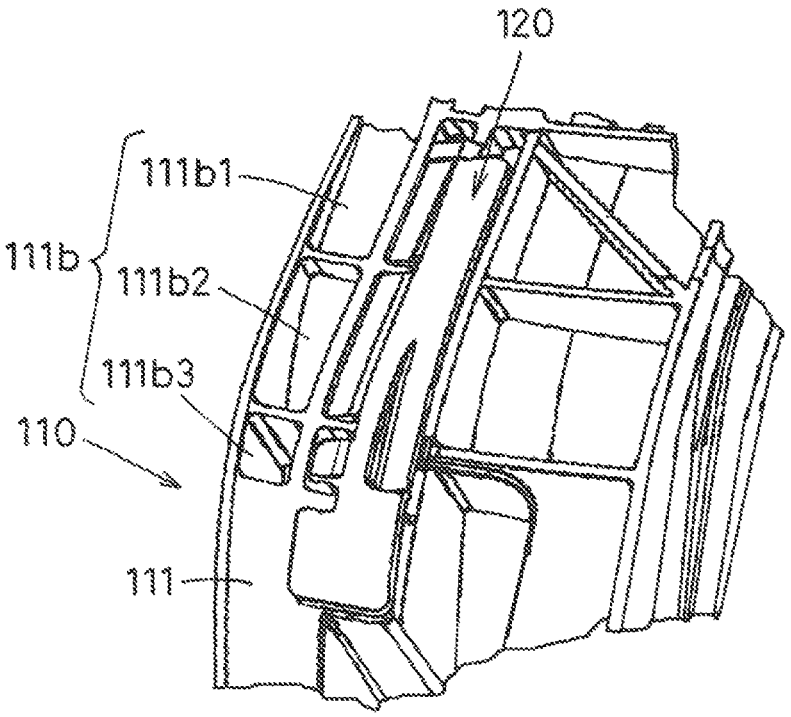
FIG. 25 is a perspective view showing a recess in which the guide member is attached.
Figure 26:
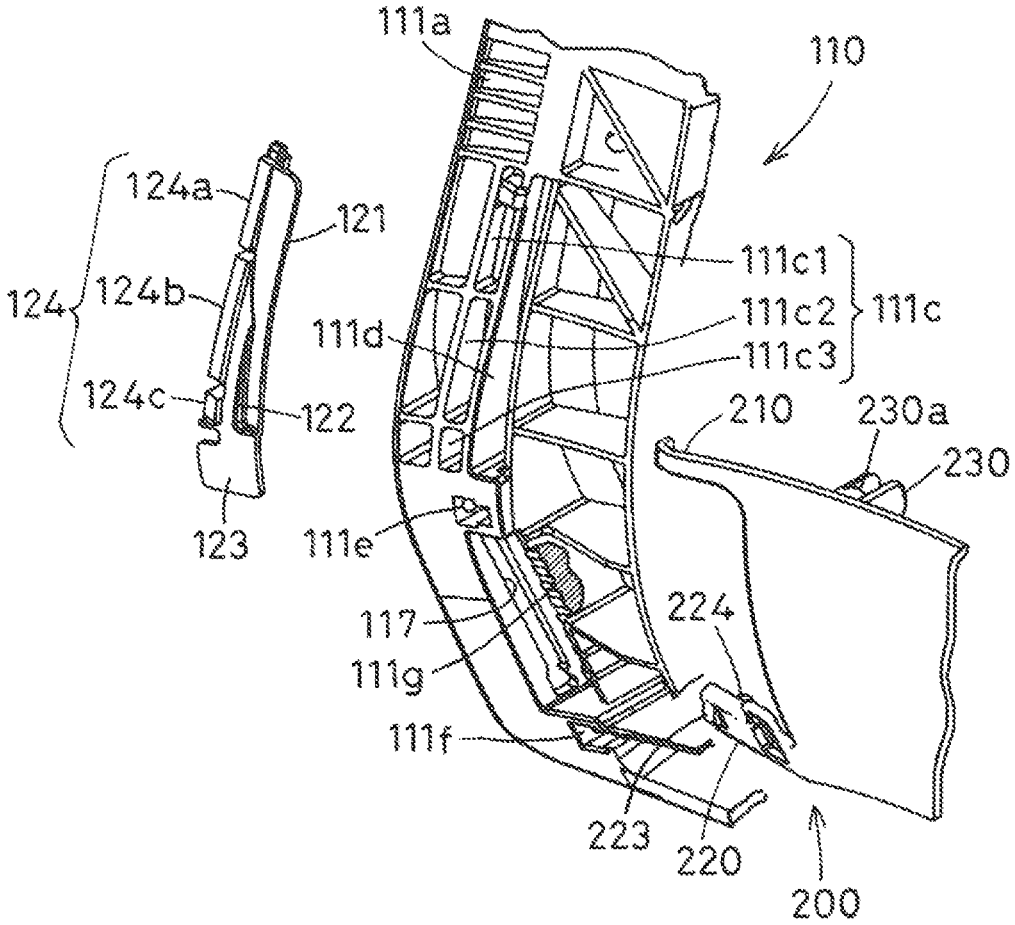
FIG. 26 is an enlarged perspective view of parts of the inner shell and lumbar support and the guide member.

FIG. 24 is an enlarged perspective view of the right and left guide members 120; FIG. 25 is a perspective view of the recesses 111*c*, 111*d* over which the guide member 120 is mounted; and FIG. 26 is an enlarged perspective view of parts of the inner shell 110 and lumbar support 200 and the guide member 120.

In FIG. 24, the guide member 120 is narrow and comprises an arcuate guide portion 121; a cover portion 123 provided under the guide portion 121 with a step 122; and a rectangular-sectioned fixing portion 124 formed outward of the guide portion 121 and the cover portion 123. The fixing portion 124 has an upper engagement portion 125 at the upper end; and a lower engagement portion 126 at the lower end having an engagement claw 126*a*, and divided into three. The guide member for providing the guide portion in the inner shell 110 is merely one example in the embodiment, and is not limited. The guide portion prevents the guide support portion 210 of the lumbar support 200 from falling off and supports to guide the guide support portion 210 to move vertically, and its structure is not limited. The guide portion may be molded together with the inner shell 110.

Figure 29:
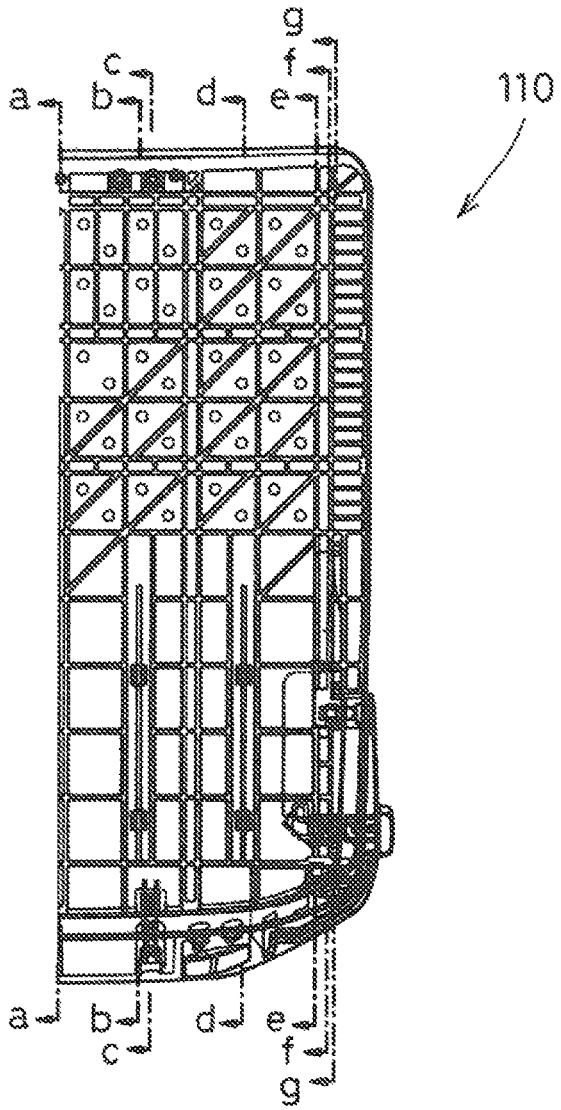
FIG. 29 is a front view showing a right half of the inner shell.
Figure 30:
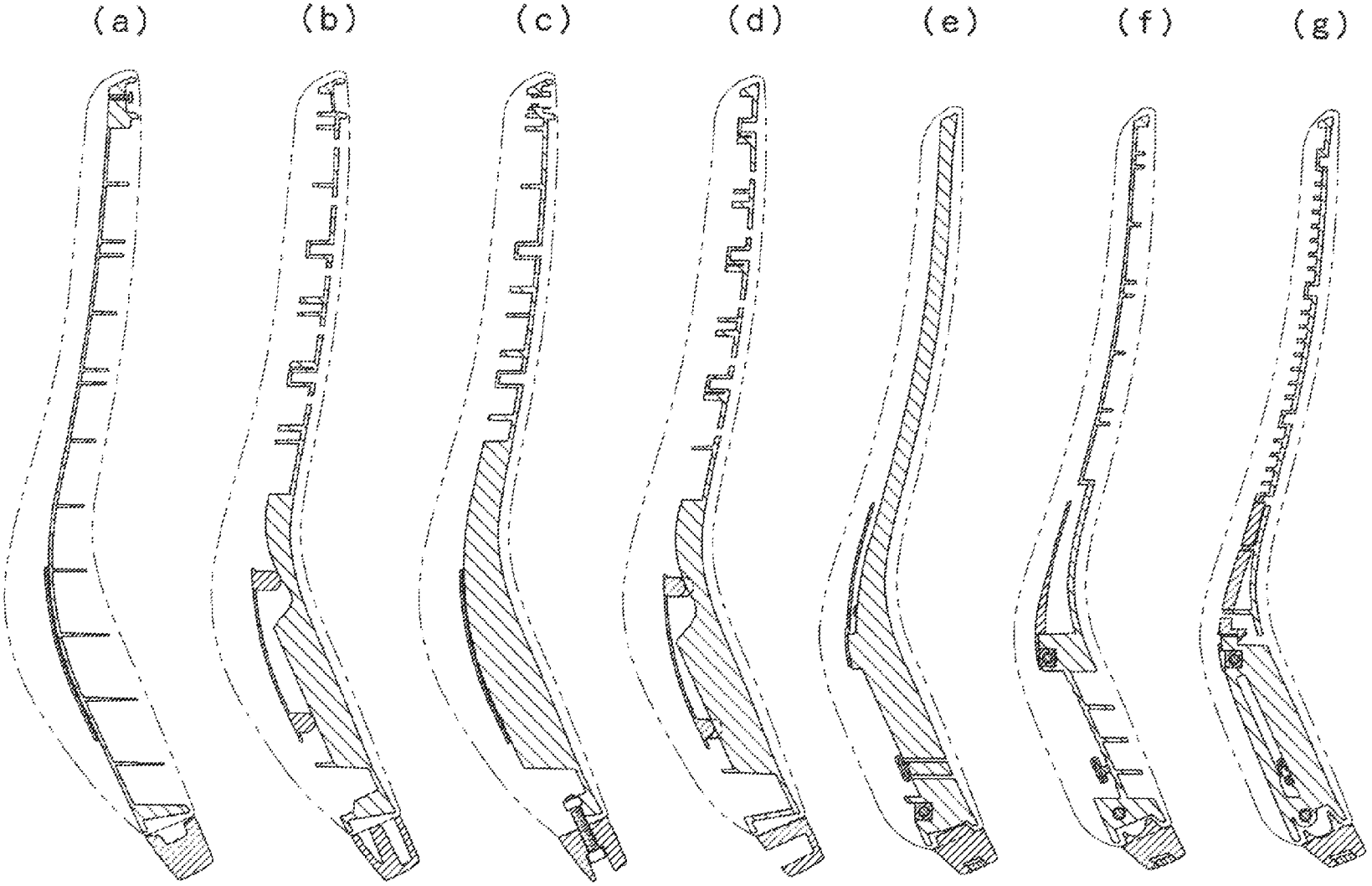
FIGS. 30 (*a*), (*b*), (*c*), (*d*), (*e*), (*f*) and (*g*) are vertical sectional views taken along the lines a-a, b-b, c-c, d-d, e-e, f-f and g-g in FIG. 29 respectively.

FIG. 29 is a front elevational view of a right half of the inner shell 110, and FIG. 30 (*a*), (*b*), (*c*), (*d*), (*e*), (*f*), (*g*) are vertical sectional side views taken along the lines a-a, b-b, c-c, d-d, e-e, f-f, g-g respectively in FIG. 29. FIGS. 33, 34, 35, 36 are partial enlarged views of (b), (e), (f), (g) respectively in FIG. 30.

Figure 31:
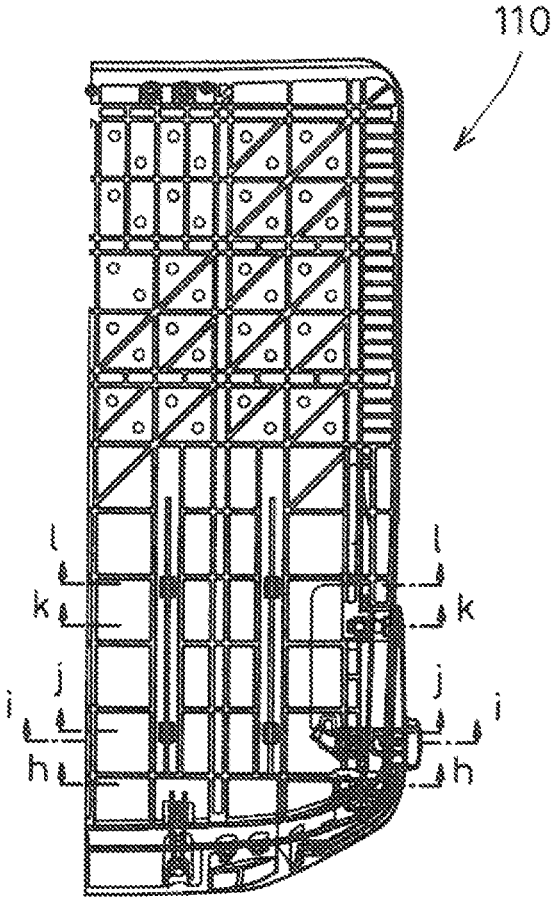
FIG. 31 is a front view of a right half of the inner shell.
Figure 32:
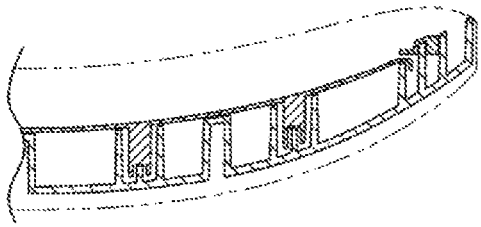
FIGS. 32 (*h*), (*i*), (*j*), (*k*) and (*l*) are horizontal sectional plan views taken along the lines h-h, i-I, j-j, k-k and l-l in FIG. 31 respectively.
Figure 32:
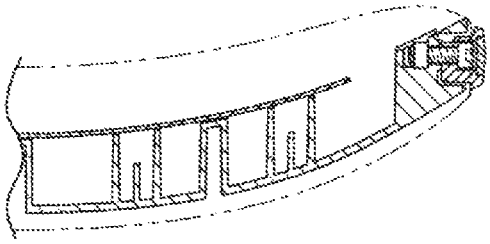
Figure 32:
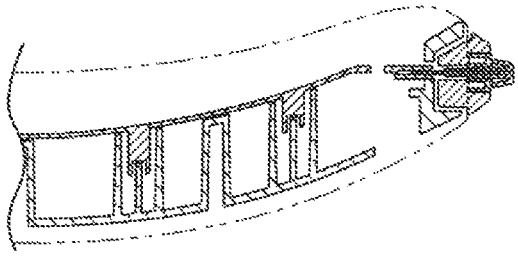
Figure 32:
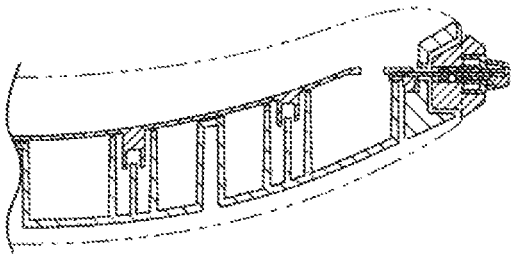
Figure 32:
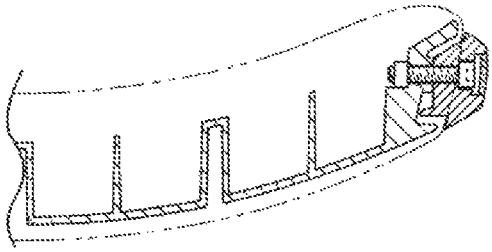

FIG. 31 is a front elevational view of a right half of the inner shell 110, and FIG. 32(*h*), (*i*), (*j*), (*j*), (*k*), (*i*) are horizontal sectional plan views taken along the lines h-h, i-i, j-j, k-k, l-l in FIG. 31 respectively.

In FIGS. 29 and 31, the lines to be normally drawn by broken lines are shown by solid lines to clarify positional relationships.

Figure 37:
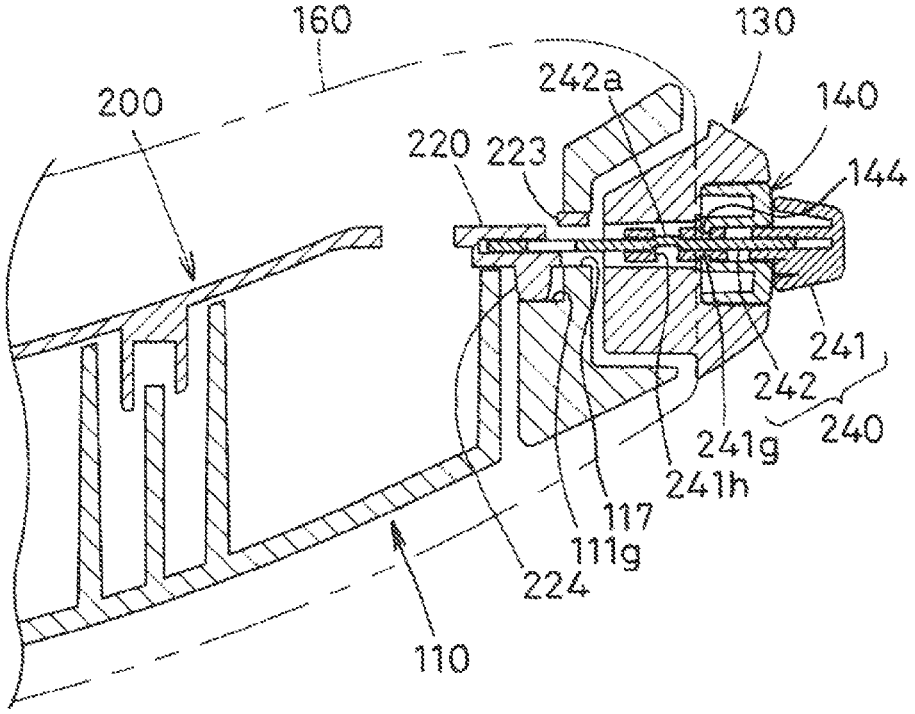
FIG. 37 is an enlarged view of part of (j) in FIG. 32.
Figure 38:
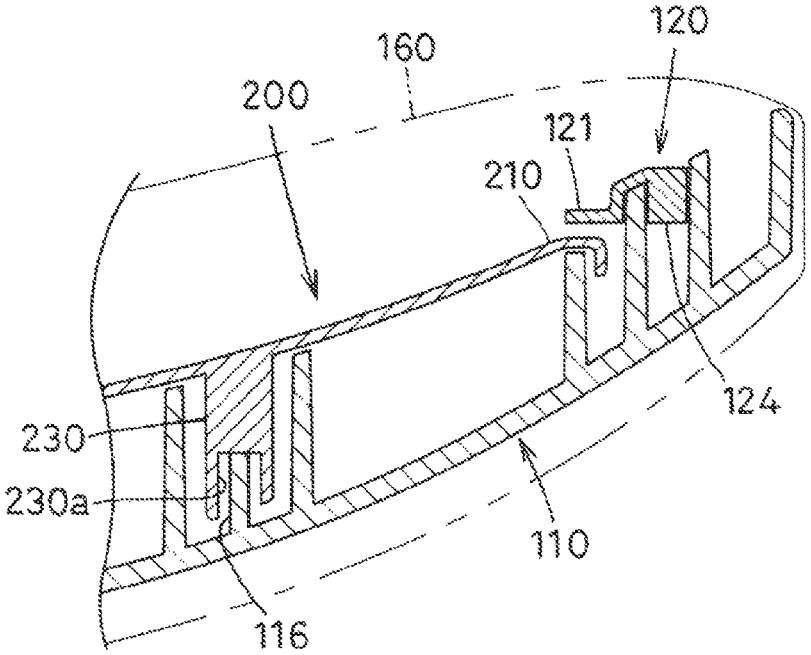
FIG. 38 is an enlarged view of part of (l) in FIG. 32.

FIGS. 37 and 38 are partial enlarged views of (j) and (i) in FIG. 32 respectively.

Figure 36:
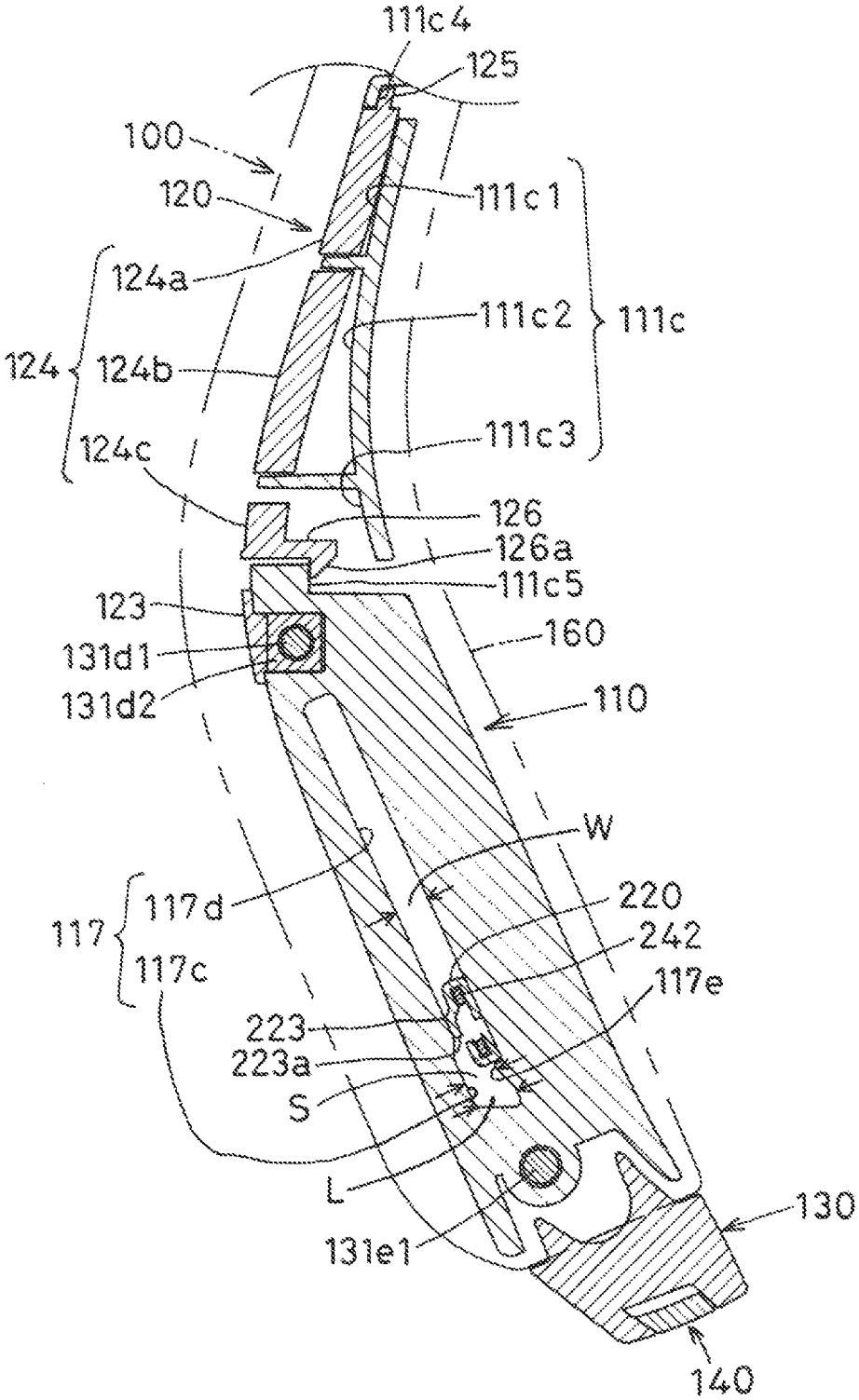
FIG. 36 is an enlarged view of part of (g) in FIG. 30.

In FIG. 36, there are provided engaged portions 111*c*4, 111*c*5 on the upper-stage recess 111*c*1 and lower-stage recess 111*c*3 of the recess 111*c* on the side edge 111 of the inner shell 110 over which the fixing portion 124 of the guide member 120 engages. The fixing portion 124 of the guide member 120 engages in the recess 111*c* of the side edge 111, and the engagement claws 126*a* of the upper and lower engagement portions 125 and 126 of the guide member 120 engage with the engaged portions 111*c*4, 111*c*5 respectively, so that the guide member 120 is mounted to the side edge 111 as shown in FIG. 25. The three fixing portions 124*a*, 124*b*, 124*c* into which the guide member 120 is divided engage in the upper recess 111*c*1, the middle recess 111*c*2 and the lower recess 111*c*3 respectively.

Meanwhile, in FIGS. 21 and 23, the lumbar support 200 which is as wide as the inner shell 110 is arcuate backward in a plan view and curved forward in a side view.

At the right and left sides, a guide support portion 210 and an operation support portion 220 are provided on upper and lower parts respectively. The lumbar support 200 is supported by the inner shell 110 with four points of the right and left guide support portions 210 and the right and left operation support portions 220.

The guide support portion 210 is coplanar with the lumbar support 200 and a vertical width of the guide support portion 210 is much smaller than that of the lumbar support 200.

Figure 34:
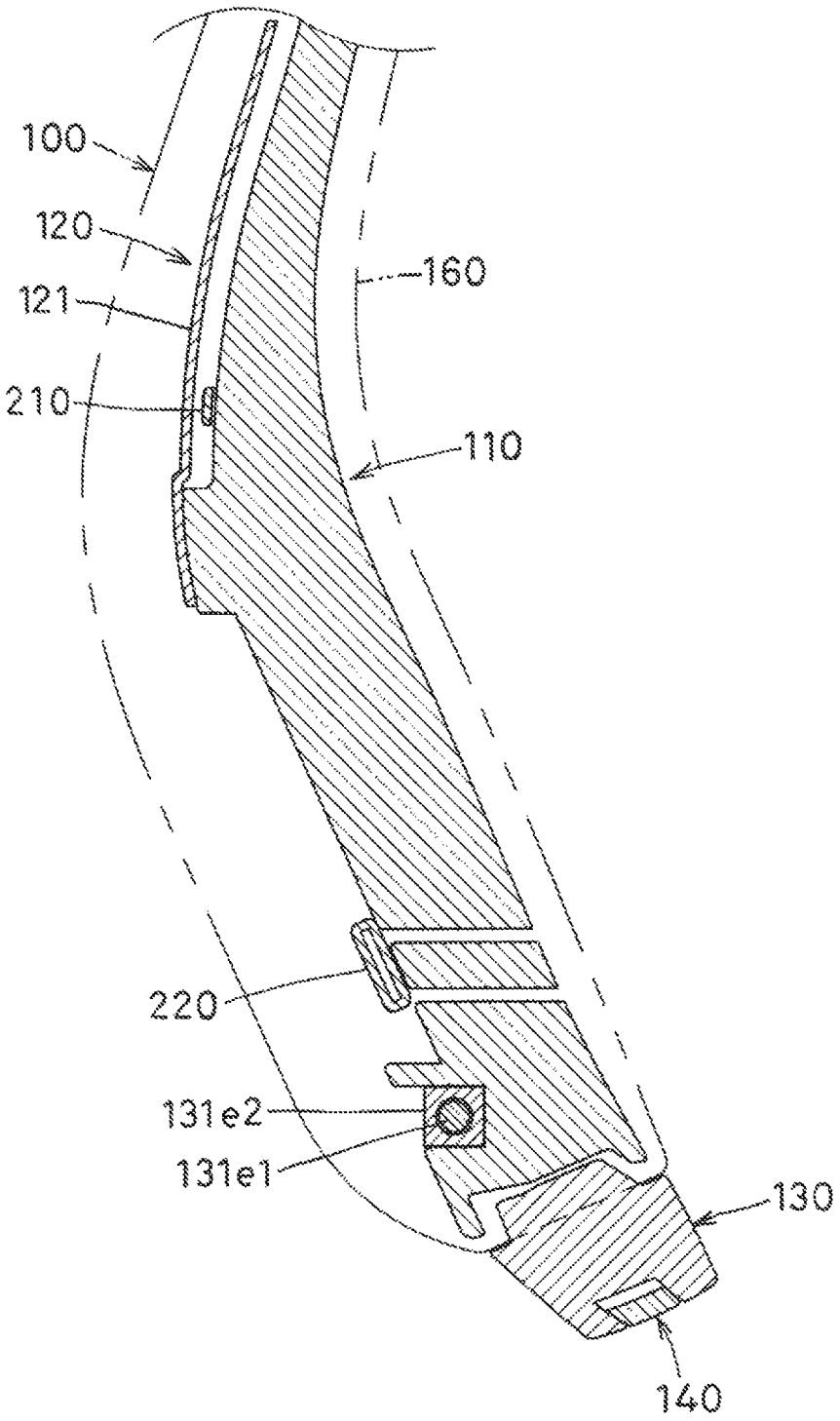
FIG. 34 is an enlarged view of part of (e) in FIG. 30.

In FIG. 34, the guide support portion 210 is disposed between the front surface of the inner shell 110 and the guide portion 121 of the guide member 120 mounted as above and is supported to move vertically.

In FIG. 21, four sliding-contact portions 230 project on the back surface of the lumbar support 200 at upper and lower parts. At the free end of the sliding-contact portion 230, there is formed a sliding-contact groove 230*a* which is open vertically and backward. In FIG. 38, the guide projection 116 in FIG. 21 support frames 77 on the inner shell 110 freely fits in the sliding-contact groove 230*a* to slide vertically.

In order to attach the lumbar support 200 to the inner shell 110, first, it is necessary to mount the operation support portion 220 of the lumbar support 200 to the inner shell, which will be described below.

Figure 27:
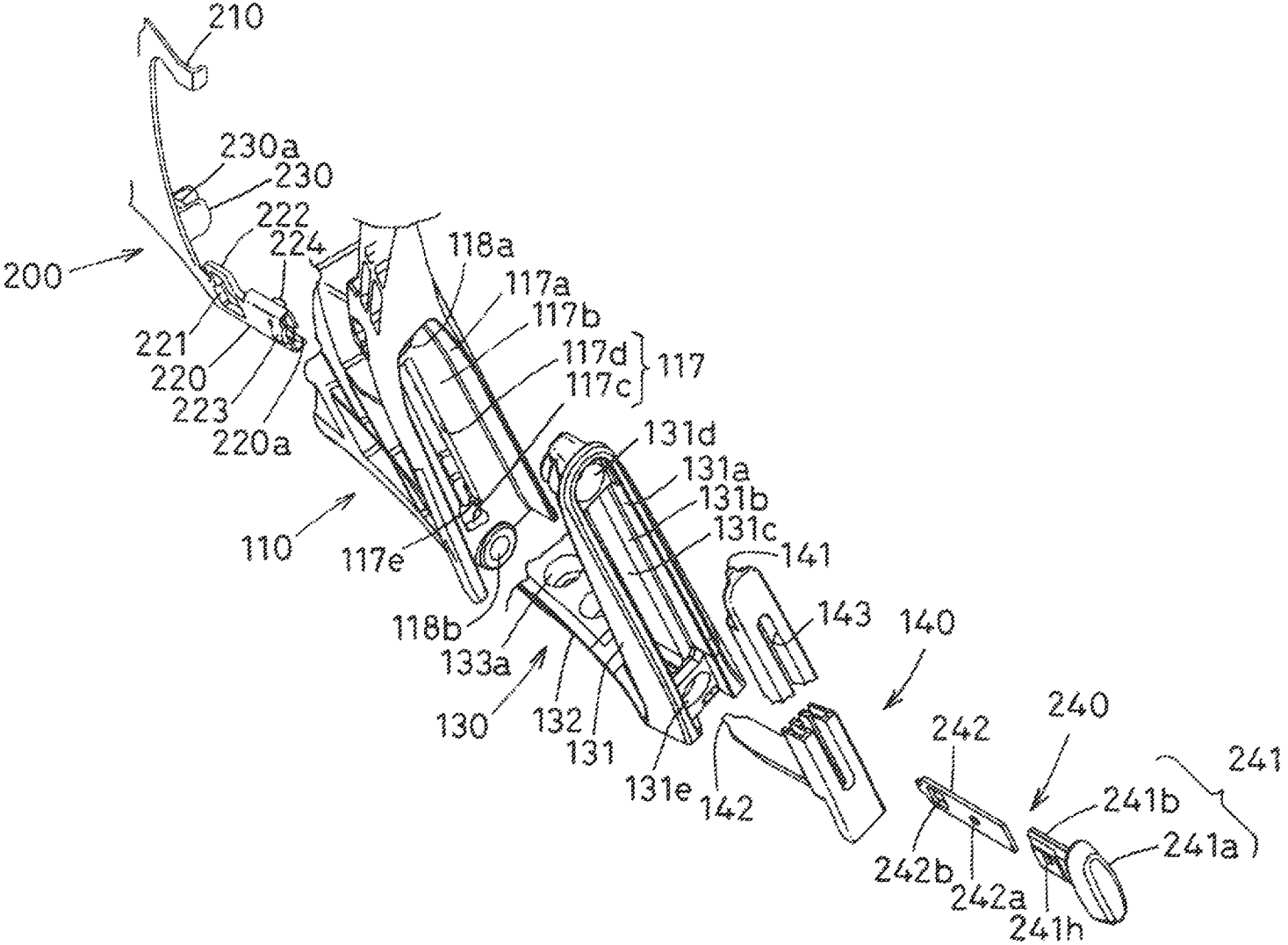
FIG. 27 is an exploded perspective view of how to attach an operation support portion of the lumbar support into the inner shell.

FIG. 27 is an exploded perspective view of how the operation support portion 220 of the lumbar support 200 is mounted to the inner shell 110.

In FIGS. 21 and 27, at the lower part of the right and left side edges 111 of the inner shell 110, there is formed a recess 117*a* which is open sideward and downward. Along a back wall 117*b* of the recess 117*a*, there is formed a vertical opening 117.

In FIG. 36, the opening 117 comprises an engagement opening portion 117*c* in which an operation support portion 220 of the lumbar support 200 fits; and a moving opening portion 117*d* through which the operation support portion 220 is vertically movable without falling off when the lumbar support 200 usually moves vertically after fitting the operation support portion 220. The engagement opening portion 117*c* communicates with the lower end of the moving opening portion 117*d*, but may communicate with the upper end thereof.

The width L of the engagement opening portion 117*c* is larger than the width W of the moving opening portion 117*d*.

There is provided a movement-preventing portion 117*e* for preventing the operation support portion 220 of the lumbar support 220 from moving from the moving opening portion 117*d* to the engagement opening portion 117*c*. In this embodiment, at a portion in which the engagement opening portion 117*c* communicates with the moving opening portion 117*d*, a portion having width S smaller than the width W of the moving opening portion 117 is provided to form the movement-preventing portion 117*e* by partially projecting the inner wall.

Meanwhile, in FIGS. 23 and 27, the operation support portion 220 of the lumbar support 200 has a bendable portion 222 which has an opening 221 and is easily bendable elastically; and an inserted portion 220*a* in which a free end of the handle 240 (later described) can put.

In FIG. 27, on the front surface closer to the free end of the operation support portion 220, there is formed a spring member 223 one end of which is coupled to the operation support portion 220, the other end comprising a free end 223*a* projecting forward. On the back surface of the operation support portion 220, a sliding-contact projection 224 projects backward.

The operation support portion 220 of the lumbar support 200 is put through the opening 117 as below.

In FIG. 36, any one of the right and left operation support portions 220 of the lumbar support 200, for example, the right operation support portion 220, is put through a wider-opening portion of the engagement opening portion 117*c* of the right opening from inside of the inner shell 110. Then, while the free end 223*a* of the spring member 223 is in contact with the inner wall of the engagement opening portion 117*c*, the operation support portion 220 is moved upward through the narrower opening portion to the movement opening portion using elastic deformation of the spring member 223. The operation support portion 220 moved into the movement opening portion is prevented from moving to the engagement opening portion by the movement preventing portion 117*e*.

Then, the left operation support portion 220 of the lumbar support 200 is bent using the easily-bendable portion 222 in FIG. 23, and is put through the left opening 117 of the inner shell 110.

In FIGS. 22 and 26, the vertical sliding-contact surface 111*g* is provided on the inner side of the opening 117 of the inner shell 110.

In FIG. 26, part close to the sliding-contact surface 111*g* is partially cut away.

Figure 35:
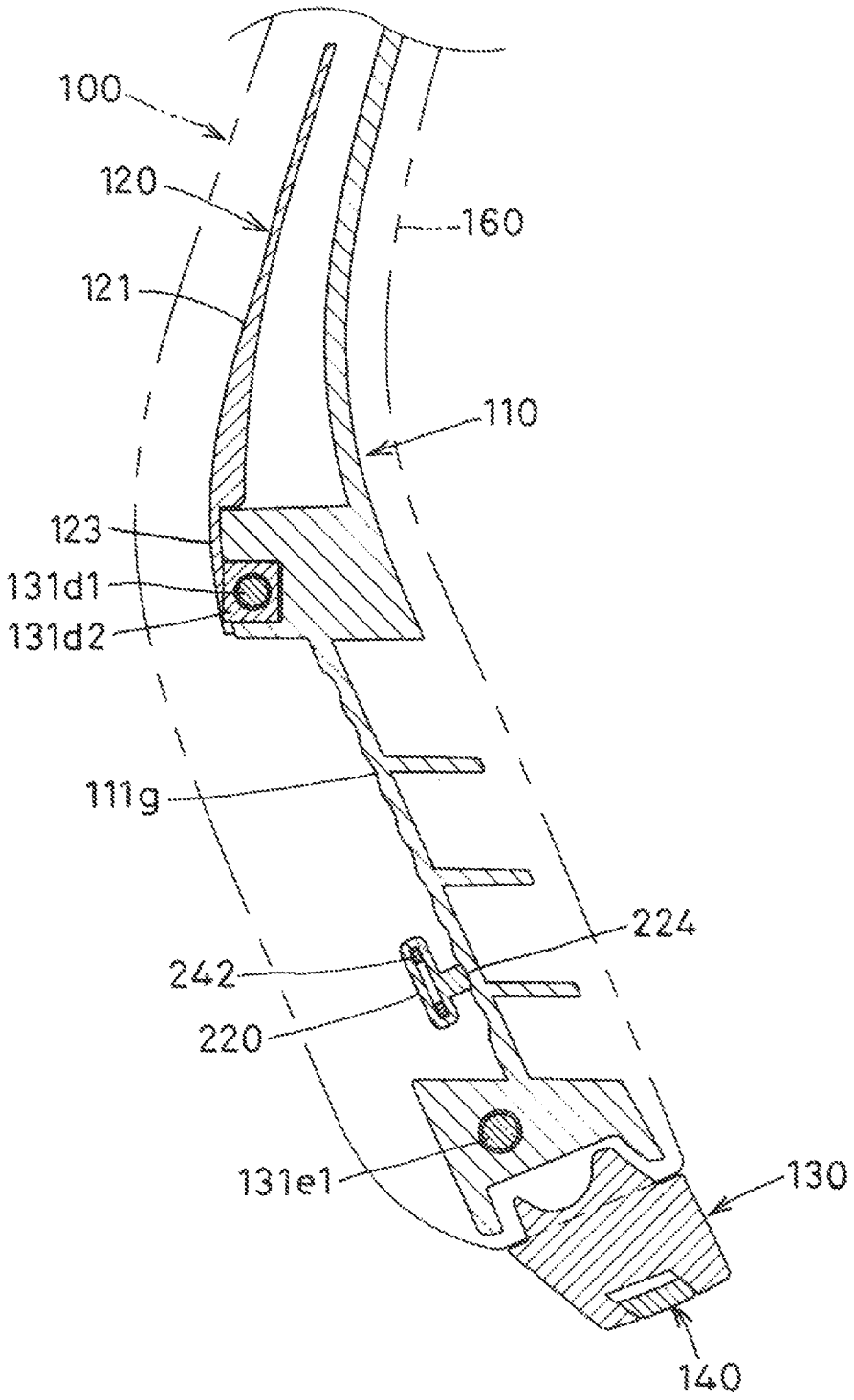
FIG. 35 is an enlarged view of part of (f) in FIG. 30.

The right and left operation support portion 220 of the lumbar support 200 are put through the right and left openings 117 of the inner shell 110 respectively and supported. In FIG. 35, the sliding-contact projection 224 on the back surface of the operation support portion 220 is in contact with the sliding-contact surface 111*g*. With vertical motion of the lumbar support 200, the sliding-contact portion 224 is in sliding contact with the sliding-contact surface 111*g*.

In FIG. 21, into the right and left recesses 117*a* in which the opening 117 of the inner shell 110 is formed, the upright frames 131 of the backrest support 130 are put from below.

In FIGS. 21 and 23, the backrest support 130 is shaped like U viewed from front, and the upright frames 131 stand on the right and left ends of the lateral frame 132.

A pair of connecting recesses 133 is formed on the front surface of the lateral frame 132, and two bolt-through holes 133*a* are formed to go into the connecting recess 133 from above.

In FIG. 21, the rear ends of the pair of backrest support frames 7 pivotally mounted to the base 5 is put in the connecting recesses 133. A bolt 133 is put through the bolt-through hole 133*a* and is bound in an internal thread 77*a* at the rear end of the backrest support frame 77. Thus, the backrest support 130 is fixed to the backrest support frame 77.

In FIG. 27, in the upright frame 131 of the backrest support 130, there is formed a recess 131*a* which is open rightward and downward, and through a back wall 131*b* of the recess 131*a*, there is formed a vertical opening 131*c*.

Over and under the opening 131*c* in the recess 131*a*, there are formed bolt-through holes 131*d*, 131*e*

In FIG. 23, there is formed a pair of bolt-through holes 132*a* in the lateral frame 132 at an inner side of the connecting recess 131*a*.

The backrest support 130 is mounted to the inner shell 110 as below.

In FIG. 21, the inner shell 110 is placed over the backrest support 130 mounted to the backrest support frame 77 by inserting the upright frame 131 of the backrest support 130 into the recess 117*a* in which the opening 117 is formed. Then, in FIG. 22, in the nut-holding portions 111*e*, 111*f* on the side edge 111 of the inner shell 110 and nut-holding portion 113*b* on the lower edge 113, nuts 131*d*2, 131*e*2, 132*a*2 in FIG. 21 are formerly disposed. Bolts 131*d*1, 131*e*1, 132*a*1 are passed through bolt-through holes 131*d*, 131*e*, 132*a* of the backrest support 130 in FIG. 27 and through bolt-through holes 118*a*, 118*b* in FIG. 27 and bolt-through notch 113*b* in FIG. 22 and bound with the nuts 131*d*2, 131*e*2, 132*a*2. Thus the inner shell 110 is firmly mounted to the backrest support 130.

The cover member 140 is mounted over the recess 131*a* of the upright frame 131 of the backrest support 130. In FIGS. 23 and 27, the cover member 140 has a lower curved part, and has an upper engagement portion 141 at the upper end and a lower engagement portion 142 at the lower end having an inward and downward engagement claw 142*a*.

The cover member 140 has a vertical opening 143.

Figure 28:
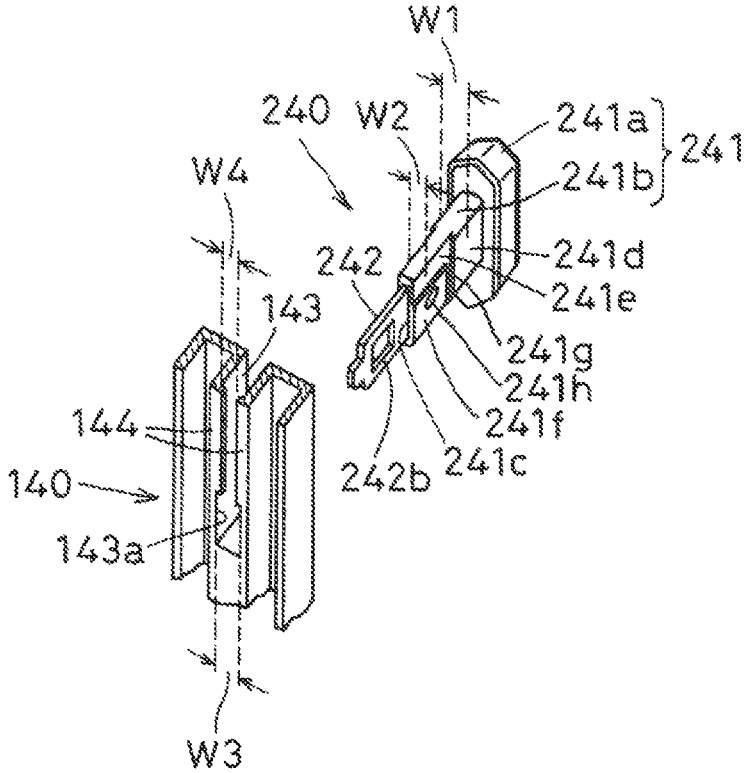
FIG. 28 is an enlarged view showing how to mount the handle to the cover member, (a) and (b) being perspective views before and after attachment respectively.
Figure 28:
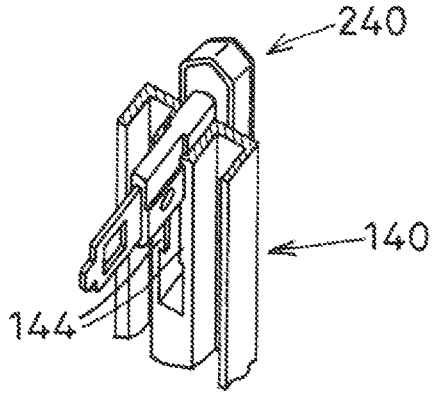

FIG. 28 is an enlarged view in which the handle 240 is mounted to the cover member 140. (a) is a perspective view before connection and (b) is a perspective view of a connected state.

The cover member 140 is broken and is partially shown.

In FIGS. 27 and 28, as shown in a cross-section of the cover member 140, a pair of inward portions 144*b* is provided.

The handle 240 connected to the operation support portion 220 of the lumbar support 200 comprises a grip 241 and a coupling metal portion 242. The grip 241 comprises a gripped portion 241*a* gripped when the occupant adjusts a vertical position of the lumbar support 200; and an inward projection 241*b* for coupling the coupling metal portion 242 to the grip 241. The coupling metal portion 242 comprises a horizontally long plate and has a circular projection 242*a* and a rectangular through hole 242*b* close to the free end. The inward projection 241*b* of the grip 241 has a hole 241*c* through which the coupling metal portion 242 goes, and a rectangular shape.

In FIG. 28, the inward projection 241*b* comprises a thicker portion 241*d* and a thinner portion 241*e* which has a thicker small portion 241*f* on a lower half. So a vertical groove 241*g* is formed between the thicker portion 241*d* and the thin small portion 241*f*.

The thickness of the thicker portion 241*d* and thicker small portion 241*f* is slightly smaller than the width W3 of the opening 143 of the cover member 140 and is larger than the distance W4 of a gap between the inward portions 144 and 144. The thickness W2 of the thinner portion 241*e* is slightly smaller than the distance of a gap between the inward portions 144 and 144. The vertical length of the thicker small portion 241*f* is slightly smaller than the vertical length of a lower opening portion 143*a* having an opening width W3 under the inward portion 144.

The thicker small portion 241*f* has a circular hole.

The coupling metal portion 242 is inserted into the hole 241*c* at the free end of the grip 241, and the circular projection 242*a* on the coupling metal portion 242 is fitted in a circular hole 241*h*. Hence, in FIG. 28, the coupling metal portion 242 is coupled with the grip 241 to form the handle 240.

The handle 240 is inserted into the opening 143 of the cover member 140, and the thicker small portion 241*f* of the handle 240 is passed through the lower opening portion 143*a* of the cover member 140. In FIG. 28(*b*), the inward portion 144 is fitted in the groove 241*g* and the handle 240 is moved upward. Hence, the handle 240 can be attached to the cover member 140 without falling off in FIG. 37.

In FIG. 27, the cover member 140 attached to the handle 240 is attached to the recess 131*a* of the upright frame 131 of the backrest support 130 as below. On the upper part of the recess 131*a*, there is formed an engaged portion (not shown) with which the upper engagement portion 141 of the cover member 140 engages. On the lateral frame 132 of the backrest support 130, there is an engaged portion (not shown) which engages with the lower engagement portion 142 of the cover member. The cover member 140 is fitted into the recess 131*a* of the backrest support 130, and the cover member 140 with the handle 240 is mounted to the backrest support 130.

Means for mounting the guide support portion 210 and operation support portion 220 of the lumbar support 200 to the inner shell 110, means for mounting the guide member 120 to the inner shell 110, means for mounting the inner shell 110 to the backrest support 130, means for attaching the handle 240 to the cover member 140 and means for mounting the cover member 140 to the backrest support 130 were described in detail.

Then, it will be described how to mount the lumbar support 200 to the inner shell 110 by the mounting means and how to mount the backrest 100 constructed as above to the backrest support 130.

The operation support portion 220 on the lower side of the lumbar support 200 is inserted into the engagement opening portion 117*c* of the opening 117 in the lower side of the inner shell 110 and moved upward to the motion opening portion 117*a* at a usual position for moving the lumbar support 200 up and down in FIG. 36. Thus, the operation support portion 220 is supported to move vertically without falling off the opening 117. The free end of the spring member 223 as biasing means comes in contact with the inner wall of the motion opening portion 117*a*, so that the operation support portion 220 is elastically biased backward.

At the same time, the sliding-contact projection 224 on the back surface of the operation support portion 220 comes in sliding contact with the sliding-contact surface 111*g* of the inner shell 110 together with vertical motion of the lumbar support 200. The sliding-contact surface 111*g* comprises waves comprising a plurality of engagement portions which engages the sliding-contact projection 224.

The guide support portion 210 on the upper side of the lumbar support 200 is supported by the guide portion 121 of the guide member 120, and the guide member 120 is mounted on the recess 111*b* in the side edge 111 of the inner shell 110.

Hence, the guide support portion 210 is supported by the guide 120 to move vertically without falling off in FIG. 34.

The guide projection 116 of the inner shell 110 is inserted into the sliding-contact groove 230*a* of the sliding-contact portion 230 on the upper and lower parts of the lumbar support 200. Thus, the sliding-contact portion 230 moves in sliding contact along the front edge of the guide projection 116 together with vertical motion of the lumbar support 200.

Figure 33:
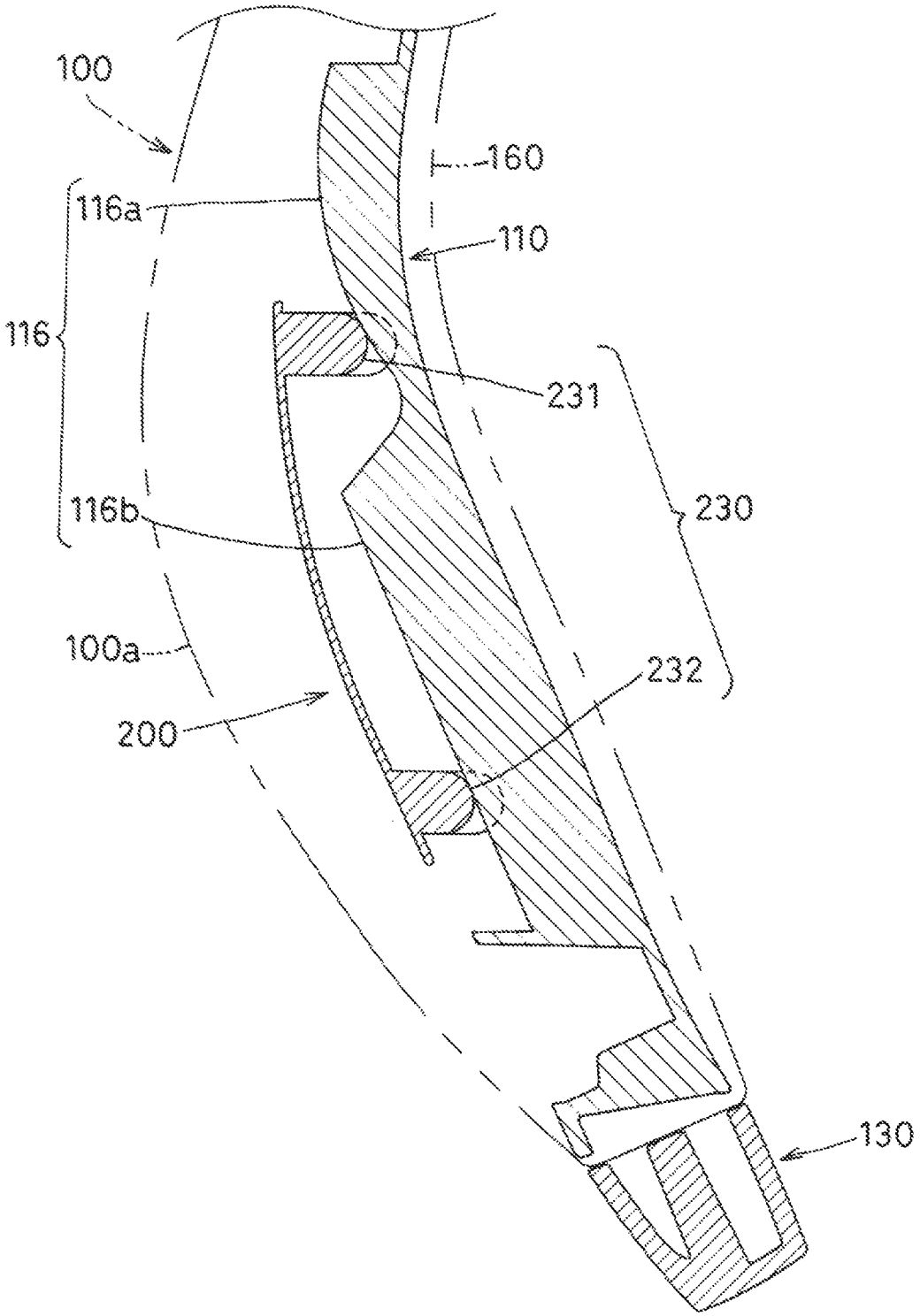
FIG. 33 is an enlarged view of part of (b) in FIG. 30.

In FIG. 33, the guide projection 116 comprises an upper sliding-contacted portion 116*a* with which the upper sliding-contact portion 231 of the lumbar support 200 comes in sliding contact; a lower sliding-contact portion 116*b* with which the lower sliding-contact portion 232 comes in sliding contact. The front edges of the upper sliding-contacted portion 116*a* and lower sliding-contacted portion 116*b* gradually projects upward from the lower end to the upper end.

In FIG. 20, in the backrest 100, a back-support portion 100*a* for supporting the back of the occupant projects forward viewed from side. The guide projection 116 is positioned at or close to the back support portion 100*a*. Vertical positions of the lower end of the upper sliding-contacted portion 116*a* and of the upper end of the lower sliding-contacted portion 116*b* are approximately equal to a vertical position of the back-support portion 100*a* of the backrest 100. The front edge of the guide projection 116 is positioned behind the guide member 120.

Then, after the cushion member 150 is positioned over the inner shell 110 and front surface of the lumbar support 200, a bag-like skin member 160 formerly which is formed to be similar to the shape of the backrest and is open at the lower end is covered from above, and the lower end of the skin member 160 is fastened with a tacker needle from below to the lower edge of the inner shell 110. At the lower ends of right and left sides of the skin member 160, a notch 160*a* which is similar in shape to the opening 117 of the inner shell 110 is formed.

After the backrest support 130 is mounted to the backrest support frame 77, the inner shell 110 of the backrest 100 which the skin member 160 covers is mounted to the backrest support 130.

After the handle 240 is attached to the cover member 140, the free end of the coupling metal portion 242 of the handle 240 is inserted into the inserted portion 220*a* of the operation support portion 220, and the cover member 140 is put in the recess 131*a* of the upright frame 131 of the upright frame 131.

As mentioned above, the backrest 100 on which the lumbar support 200 is attached is firmly mounted to the backrest support 130 mounted to the backrest frame 7.

In the second embodiment of the chair, a typical example is illustrated, and the inner shell and other members may be modified in a concrete shape. For example, the front edge of the guide projection on the backrest may be positioned in front of the guide member on the backrest, and the front edges of the upper or lower sliding-contacted portion of the guide projection on the inner shell may project forward from the upper end to the lower end of the upper or lower sliding-contacted portion.

What is claimed is:

1. A chair in which a lumbar support is movable vertically along a pair of side frame rods of a back frame, the lumbar support comprising:

a lumbar support body in which a lower edge gently projects upward so that a vertical width gradually becomes smaller from right and left ends to a middle;

four mounting portions spaced apart from each other vertically on the lumbar support body and moving vertically along a guide on each of right and left side frame rods;

an operating member connected to each of the right and left mounting portions on the lower edge of the lumbar support body; and wherein a vertical groove which is open forward is formed on a front surface of the side frame rod and a guide member for guiding the upper mounting portion is detachably attached in the vertical groove from front.

2. The chair of claim 1 wherein a horizontal length of the lumbar support body is approximately equal to a distance between facing surfaces of the pair of side frame rods, and the four mounting portions project from a side edge of the lumbar support body outward and are supported on the guide of each side frame rod.

3. The chair of claim 2 wherein the lower mounting portion projects outward from a corner at which the side edge of the lumbar support body meets the lower edge.

4. The chair of claim 1 wherein the operating member is supported to move vertically by the guide at a lower part of the side frame rod so that a grip of the operating member projects sideward from the side frame rod.

5. The chair of claim 1 wherein the lower mounting portion has a backward portion which is detachably connected from front in an inner side end of the operating member.

6. The chair of claim 1 wherein a curved portion which gently projects forward is formed on a lower part of each of the right and left side frame rods, the right and left upper mounting portions are guided to move obliquely backward and upward by the guide above the curved portion of each of the right and left side frame rods, and the right and left lower mounting portions are guided to move obliquely forward and upward by the guide below the curved portion.

7. The chair of claim 6 wherein a vertical guide hole is formed on the guide below the curved portion of each of the right and left side frame rods, and the grip of the operating member is supported by the guide hole to move vertically and projects through the guide hole from an outer side surface of the side frame rod, an inner side projecting inward from the guide of the operating member being connected to each of the right and left lower mounting portions.

8. A chair in which a lumbar support is movable vertically along a pair of side frame rods of a back frame, the lumbar support comprising:

a lumbar support body in which a lower edge gently projects upward so that a vertical width gradually becomes smaller from right and left ends to a middle;

four mounting portions spaced apart from each other vertically on the lumbar support body and moving vertically along a guide on each of right and left side frame rods;

an operating member connected to each of right and left mounting portions on a lower edge of the lumbar support body; and a curved portion which gently projects forward is formed on a lower part of each of right and left side frame rods, the right and left upper mounting portions being guided to move obliquely backward and upward by the guide above the curved portion of each of the right and left side frame rods, and right and left lower mounting portions are guided to move obliquely forward and upward by the guide below the curved portion.

* * * * *